US010386133B2

(12) United States Patent
Li et al.

(10) Patent No.: US 10,386,133 B2
(45) Date of Patent: Aug. 20, 2019

(54) ULTRA-EFFICIENT TWO-PHASE EVAPORATORS/BOILERS ENABLED BY NANOTIP-INDUCED BOUNDARY LAYERS

(71) Applicant: UNIVERSITY OF SOUTH CAROLINA, Columbia, SC (US)

(72) Inventors: Chen Li, Chapin, SC (US); Fanghao Yang, Columbia, SC (US); Yan Tong, Chapin, SC (US)

(73) Assignee: University of South Carolina, Columbia, SC (US)

( * ) Notice: Subject to any disclaimer, the term of this patent is extended or adjusted under 35 U.S.C. 154(b) by 380 days.

(21) Appl. No.: 14/279,742

(22) Filed: May 16, 2014

(65) Prior Publication Data

US 2014/0338778 A1 Nov. 20, 2014

Related U.S. Application Data

(60) Provisional application No. 61/855,494, filed on May 16, 2013.

(51) Int. Cl.
*F28F 13/18* (2006.01)

(52) U.S. Cl.
CPC ..... *F28F 13/187* (2013.01); *F28F 2255/20* (2013.01); *F28F 2260/02* (2013.01)

(58) Field of Classification Search
CPC ... F28F 13/187; F28F 2255/20; F28F 2260/02
See application file for complete search history.

(56) References Cited

U.S. PATENT DOCUMENTS

| | | | | |
|---|---|---|---|---|
| 7,290,667 | B1 * | 11/2007 | Bakajin | B01D 39/06 210/500.22 |
| 7,833,801 | B2 * | 11/2010 | Stasiak | G01N 27/3278 422/402 |
| 8,293,193 | B2 * | 10/2012 | Ricoul | B01F 5/061 210/503 |
| 9,139,416 | B2 * | 9/2015 | Li | B81B 1/00 |
| 2013/0210649 | A1 * | 8/2013 | McKnight | G01N 15/14 506/9 |
| 2014/0027005 | A1 | 1/2014 | Li et al. | |
| 2014/0034132 | A1 | 2/2014 | Li et al. | |

OTHER PUBLICATIONS

F. Yang, X. Dai, C. Li, High frequency microbubble-switched oscillations modulated by microfluidic transistors, Applied Physics Letters, 101(7) (2012) 073509-073504.

F. Yang, X. Dai, C.-J. Kuo, Y. Peles, J. Khan, C. Li, Enhanced flow boiling in microchannels by self-sustained high frequency two-phase oscillations, Int. J. Heat Mass Transf., 58(1-2) (2013) 402-412.

(Continued)

*Primary Examiner* — Samuel P Siefke
(74) *Attorney, Agent, or Firm* — Dority & Manning, P.A.

(57) ABSTRACT

Microfluidic devices, along with methods of their fabrication, are provided. The microfluidic device can include a substrate defining a microchannel formed between a pair of side walls and a bottom surface and a plurality of nanotips positioned within the microchannel and proximate to each side wall such that a boundary layer is formed along each side wall between the plurality of nanotips and the side wall upon addition of a liquid into the microchannel.

13 Claims, 20 Drawing Sheets

(56) References Cited

OTHER PUBLICATIONS

A. Kosar, C.J. Kuo, Y. Peles, Suppression of boiling flow oscillations in parallel microchannels by inlet restrictors, J. Heat Transf.-Trans. ASME, 128(3) (2006) 251-260.
A. Kosar, C.J. Kuo, Y. Peles, Boiling heat transfer in rectangular microchannels with reentrant cavities, Int. J. Heat Mass Transf., 48(23-24) (2005) 4867-4886.
D. Li, G.S. Wu, W. Wang, Y.D. Wang, D. Liu, D.C. Zhang, Y.F. Chen, G.P. Peterson, R. Yang, Enhancing Flow Boiling Heat Transfer in Microchannels for Thermal Management with Monolithically-Integrated Silicon Nanowires, Nano Letters, (2012.
A. Bar-Cohen, M. Arik, M. Ohadi, Direct liquid cooling of high flux micro and nano electronic components, Proceedings of the IEEE, 94(8) (2006) 1549-1570.
P.-H. Chen, W.-C. Chen, S.H. Chang, Bubble growth and ink ejection process of a thermal ink jet printhead, International Journal of Mechanical Sciences, 39(6) (1997) 683-695.
P. Deng, Y.-K. Lee, P. Cheng, The growth and collapse of a micro-bubble under pulse heating, Int. J. Heat Mass Transf., 46(21) (2003) 4041-4050.
H. Andersson, W. van der Wijngaart, P. Nilsson, P. Enoksson, G. Stemme, A valve-less diffuser micropump for microfluidic analytical systems, Sens. Actuator B-Chem., 72(3) (2001) 259-265.
S.G. Kandlikar, History, Advances, and Challenges in Liquid Flow and Flow Boiling Heat Transfer in Microchannels: A Critical Review, J. Heat Transf.-Trans. ASME, 134(3) (2012).
P. Cheng, G.D. Wang, X.J. Quan, Recent Work on Boiling and Condensation in Microchannels, J. Heat Transf.-Trans. ASME, 131(4) (2009).
J.R. Thome, State-of-the-art overview of boiling and two-phase flows in microchannels, Heat Transf. Eng., 27(9) (2006) 4-19.
A. Bar-Cohen, J. Sheehan, E. Rahim, Two-Phase Thermal Transport in Microgap Channels—Theory, Experimental Results, and Predictive Relations, Microgravity Science and Technology, 24(1) (2012) 1-15.
S.G. Kandlikar, Scale effects on flow boiling heat transfer in microchannels: A fundamental perspective, International Journal of Thermal Sciences, 49(7) (2010) 1073-1085.
E. Rahim, R. Revellin, J. Thome, A. Bar-Cohen, Characterization and prediction of two-phase flow regimes in miniature tubes, Int. J. Multiph. Flow, 37(1) (2011) 12-23.
A. Serizawa, Z. Feng, Z. Kawara, Two-phase flow in microchannels, Experimental Thermal and Fluid Science, 26(6-7) (2002) 703-714.
A.K.M.M. Morshed, F. Yang, M. Yakut Ali, J.A. Khan, C. Li, Enhanced flow boiling in a microchannel with integration of nanowires, Applied Thermal Engineering, 32(0) (2012) 68-75.
G. Wang, P. Cheng, A.E. Bergles, Effects of inlet/outlet configurations on flow boiling instability in parallel microchannels, Int. J. Heat Mass Transf., 51(9-10) (2008) 2267-2281.
J.H. Kim, K.N. Rainey, S.M. You, J.Y. Pak, Mechanism of Nucleate Boiling Heat Transfer Enhancement From Microporous Surfaces in Saturated FC-72, Journal of Heat Transfer, 124(3) (2002) 500-506.
H.Y. Wu, P. Cheng, Visualization and measurements of periodic boiling in silicon microchannels, Int. J. Heat Mass Transf., 46(14) (2003) 2603-2614.
H.Y. Wu, P. Cheng, Boiling instability in parallel silicon microchannels at different heat flux, Int. J. Heat Mass Transf., 47(17-18) (2004) 3631-3641.
S.G. Kandlikar, W.K. Kuan, D.A. Willistein, J. Borrelli, Stabilization of flow boiling in microchannels using pressure drop elements and fabricated nucleation sites, Journal of Heat Transfer, 128(4) (2006) 389-396.
C.J. Kuo, Y. Peles, Flow boiling instabilities in microchannels and means for mitigation by reentrant cavities, J. Heat Transf.-Trans. ASME, 130(7) (2008).
T. Chen, S.V. Garimella, Local heat transfer distribution and effect of instabilities during flow boiling in a silicon microchannel heat sink, Int. J. Heat Mass Transf., 54(15-16) (2011) 3179-3190.
P. Cheng, G. Wang, X. Quan, Recent Work on Boiling and Condensation in Microchannels, Journal of Heat Transfer, 131(4) (2009) 043211-043215.
A.E. Bergles, S.G. Kandlikar, On the nature of critical heat flux in microchannels, J. Heat Transf.-Trans. ASME, 127(1) (2005) 101-107.
S.G. Kandlikar, Fundamental issues related to flow boiling in minichannels and microchannels, Experimental Thermal and Fluid Science, 26(2-4) (2002) 389-407.
S. Moghaddam, K. Kiger, Physical mechanisms of heat transfer during single bubble nucleate boiling of FC-72 under saturation conditions—I. Experimental investigation, Int. J. Heat Mass Transf., 52(5-6) (2009) 1284-1294.
J.R. Thome, Boiling in microchannels: a review of experiment and theory, International Journal of Heat and Fluid Flow, 25(2) (2004) 128-139.
C. Choi, D.I. Yu, M. Kim, Surface wettability effect on flow pattern and pressure drop in adiabatic two-phase flows in rectangular microchannels with T-junction mixer, Experimental Thermal and Fluid Science, 35(6) (2011) 1086-1096.
J.-P. Raven, P. Marmottant, Periodic Microfluidic Bubbling Oscillator: Insight into the Stability of Two-Phase Microflows, Phys. Rev. Lett., 97(15) (2006) 154501.
P. Marmottant, J.-P. Raven, Microfluidics with foams, Soft Matter, 5(18) (2009) 3385-3388.
D. Rabaud, Manipulation of confined bubbles in a thin microchannel: Drag and acoustic Bjerknes forces, Phys. Fluids, 23(4) (2011) Apr. 2003.
T.S. Tadashi Okamoto, and Nobuko Yamamoto, Microarray fabrication with covalent attachment of DNA using Bubble Jet technology, Nature Biotechnology, 18 (2000) 438-441.
J. Kobayashi, Y. Mori, K. Okamoto, R. Akiyama, M. Ueno, T. Kitamori, S. Kobayashi, A microfluidic device for conducting gas-liquid-solid hydrogenetion reactions, Sicence, 304(5675) (2004) 1305-1308.
A.L.G. R. B. Maxwell, M. Toner, M. L. Gray, and M. A., A microbubble-powered bioparticle actuator, J. Microelectromech. Syst., 12(5) (2003) 630-640.
R. Hannemann, Thermal control of electronics: perspectives and prospects, in: Rohsenow Symposium on Future Trends in Heat Transfer, Warren M. Rohsenow Heat and Mass Transfer Laboratory, Massachusetts Institute of Technology, Cambridge, MA, 2003.
D.B. Tuckerman, R.F.W. Pease, High-performance heat sinking for VLSI, Electron Device Letters, IEEE, 2(5) (1981) 126-129.
T. Harirchian, S.V. Garimella, Boiling heat transfer and flow regimes in microchannels—a comprehensive understanding, Journal of Electronic Packaging, 133(1) (2011) 011001-011010.
M.N. Kashid, A. Renken, L. Kiwi-Minsker, Gas-liquid and liquid-liquid mass transfer in micro structured reactors, Chem. Eng. Sci., 66(17) (2011) 3876-3897.
T.Y. Liu, P.L. Li, C.W. Liu, C. Gau, Boiling flow characteristics in microchannels with very hydrophobic surface to super-hydrophilic surface, International Journal of Heat and Mass Transfer, 54(1-3) (2011) 126-134.
T. Zhang, T. Tong, J.-Y. Chang, Y. Peles, R. Prasher, M.K. Jensen, J.T. Wen, P. Phelan, Ledinegg instability in microchannels, Int. J. Heat Mass Transf., 52(25-26) (2009) 5661-5674.
B. Agostini, M. Fabbri, J.E. Park, L. Wojtan, J.R. Thome, B. Michel, State of the art of high heat flux cooling technologies, Heat Transf. Eng., 28(4) (2007) 258-281.
D. Liu, P.-S. Lee, S.V. Garimella, Prediction of the onset of nucleate boiling in microchannel flow, Int. J. Heat Mass Transf., 48(25-26) (2005) 5134-5149.
P. Cheng, H.Y. Wu, Mesoscale and Microscale Phase-Change Heat Transfer, in: J.P.H.A.B.-C. George A. Greene, I.C. Young (Eds.) Advances in Heat Transfer, Elsevier, 2006, pp. 461-563.
T. Zhang, J.T. Wen, Y. Peles, J. Catano, R. Zhou, M.K. Jensen, Two-phase refrigerant flow instability analysis and active control in transient electronics cooling systems, Int. J. Multiph. Flow, 37(1) (2011) 84-97.
L. Wojtan, R. Revellin, J.R. Thome, Investigation of saturated critical heat flux in a single, uniformly heated microchannel, Experimental Thermal and Fluid Science, 30(8) (2006) 765-774.

(56) References Cited

OTHER PUBLICATIONS

C.J. Kuo, Y. Peles, Pressure effects on flow boiling instabilities in parallel microchannels, Int. J. Heat Mass Transf., 52(1-2) (2009) 271-280.
S. Vafaei, D. Wen, Critical heat flux (CHF) of subcooled flow boiling of alumina nanofluids in a horizontal microchannel, Journal of Heat Transfer, 132(10) (2010) 102404-102407.
S.-S. Hsieh, C.-Y. Lin, Correlation of critical heat flux and two-phase friction factor for subcooled convective boiling in structured surface microchannels, Int. J. Heat Mass Transf., 55(1-3) (2012) 32-42.
H. Ohta, K. Inoue, M. Ando, K. Watanabe, Y. Ito, Detailed Experimental Investigation on the Observed Scattering in Heat Transfer Characteristics for Flow Boiling in a Small Diameter Tube, ASME Conference Proceedings, 2007(4272X) (2007) 41-49.
A. Mukherjee, S.G. Kandlikar, The effect of inlet constriction on bubble growth during flow boiling in microchannels, Int. J. Heat Mass Transf., 52(21-22) (2009) 5204-5212.
D.W. Fogg, K.E. Goodson, Design Considerations for the Effects of Liquid Compressibility in Microchannel Flow Boiling, ASME Conference Proceedings, 2006(47853) (2006) 271-280.
C.J. Kuo, A. Kosar, Y. Peles, S. Virost, C. Mishra, M.K. Jensen, Bubble dynamics during boiling in enhanced surface microchannels, J. Microelectromech. Syst., 15(6) (2006) 1514-1527.
M.E. Steinke, S.G. Kandlikar, An experimental investigation of flow boiling characteristics of water in parallel microchannels, J. Heat Transf.-Trans. ASME, 126(4) (2004) 518-526.
P.H. Lin, B.R. Fu, C. Pan, Critical heat flux on flow boiling of methanol-water mixtures in a diverging microchannel with artificial cavities, Int. J. Heat Mass Transf., 54(15-16) (2011) 3156-3166.
L. Po Chang, P. Chin, Boiling heat transfer and two-phase flow of water in a single shallow microchannel with a uniform or diverging cross section, Journal of Micromechanics and Microengineering, 18(2) (2008) 025005.
E.A. Browne, G.J. Michna, M.K. Jensen, Y. Peles, Microjet array single-phase and flow boiling heat transfer with R134a, Int. J. Heat Mass Transf., 53(23-24) (2010) 5027-5034.
J.R. Thome, L. Consolini, Mechanisms of Boiling in Micro-Channels: Critical Assessment, Heat Transf. Eng., 31(4) (2010) 288-297.
Y. Yang, Y. Fujita, Flow boiling heat transfer and flow pattern in rectangular channel of mini-gap, ASME Conference Proceedings, 2004(41642) (2004) 573-580.
M. Cortina Díaz, J. Schmidt, Flow boiling of n-Hexane in small channels: heat transfer measurements and flow pattern observations, Chemical Engineering & Technology, 30(3) (2007) 389-394.
M. Monde, Y. Katto, Burnout in a high heat-flux boiling system with an impinging jet, Int. J. Heat Mass Transf., 21(3) (1978) 295-305.
C.F. Ma, A.E. Bergles, Jet impingement nucleate boiling, Int. J. Heat Mass Transf., 29(8) (1986) 1095-1101.
D.H. Wolf, F.P. Incropera, R. Viskanta, Local jet impingement boiling heat transfer, Int. J. Heat Mass Transf., 39(7) (1996) 1395-1406.
T.S. Tadashi Okamoto, and Nobuko Yamamoto, Microarray fabrication with covalent attachment of DNA using Bubble Jet technology, in: Nature Biotechnology, 2000, pp. 438-441.
X. Geng, H. Yuan, H.N. Oguz, A. Prosperetti, Bubble-based micropump for electrically conducting liquids, Journal of Micromechanics and Microengineering, 11(3) (2001) 270-276.
I. Mudawar, Assessment of high-heat-flux thermal management schemes, IEEE Trans. Compon. Packaging Technol., 24(2) (2001) 122-141.
D.W. Zhou, C.F. Ma, J. Yu, Boiling hysteresis of impinging circular submerged jets with highly wetting liquids, International Journal of Heat and Fluid Flow, 25(1) (2004) 81-90.
D.W. Zhou, C.F. Ma, Local jet impingement boiling heat transfer with R113, Heat and Mass Transfer, 40(6) (2004) 539-549.
A. Sridhar, et al., Inkjet-printing- and electroless-plating-based fabrication of RF circuit structures on high-frequency substrates, Journal of Micromechanics and Microengineering, 19(8) (2009) 085020.
D. Guo, J.J. Wei, Y.H. Zhang, Enhanced flow boiling heat transfer with jet impingement on micro-pin-finned surfaces, Applied Thermal Engineering, 31(11-12) (2011) 2042-2051.
H.Z. Cao, H.B. Xu, N. Liang, C.Q. Tian, Experiment investigation of R134a flow boiling process in microchannel with cavitation structure, Heat Transf. Eng., 32(7-8) (2011) 542-553.
H.T. H. Kubo, and Hiroshi Honda, Effects of size and number density of micro-reentrant cavities on boiling heat transfer from a silicon chip immersed in degassed and gas-dissolved FC-72, Journal of Enhanced Heat Transfer, 6(2-4) (1999) 151-160.
W. Hailei, R.B. Peterson, Enhanced boiling heat transfer in parallel microchannels with diffusion brazed wire mesh, Components and Packaging Technologies, IEEE Transactions on, 33(4) (2010) 784-793.
Singh, V. Sathyamurthy, W. Peterson, J. Arendt, D. Banerjee, Flow boiling enhancement on a horizontal heater using carbon nanotube coatings, International Journal of Heat and Fluid Flow, 31(2) (2010) 201-207.
C. Hutter, K. Sefiane, T.G. Karayiannis, A.J. Walton, R.A. Nelson, D.B.R. Kenning, Nucleation site interaction between artificial cavities during nucleate pool boiling on silicon with integrated micro-heater and temperature micro-sensors, Int. J. Heat Mass Transf., 55(11-12) (2012) 2769-2778.
A. Bar-Cohen, K.J.L. Geisler, Cooling the Electronic Brain, in: Mechanical Engineering, 2011, pp. 38-41.
A.S. Kousalya, C.N. Hunter, S.A. Putnam, T. Miller, T.S. Fisher, Photonically enhanced flow boiling in a channel coated with carbon nanotubes, Applied Physics Letters, 100(7) (2012).
V. Khanikar, I. Mudawar, T. Fisher, Effects of carbon nanotube coating on flow boiling in a micro-channel, Int. J. Heat Mass Transf., 52(15-16) (2009) 3805-3817.
G. Wang, P. Cheng, H. Wu, Unstable and stable flow boiling in parallel microchannels and in a single microchannel, Int. J. Heat Mass Transf., 50(21-22) (2007) 4297-4310.
K. Chang Kun, L. Sang Min, J. Im Deok, J. Phill Gu, H. Sung Jin, K. Jong Soo, The fabrication of patternable silicon nanotips using deep reactive ion etching, Journal of Micromechanics and Microengineering, 18(7) (2008) 075007.
P. Dixit, N. Lin, J. Miao, W.K. Wong, T.K. Choon, Silicon nanopillars based 3D stacked microchannel heat sinks concept for enhanced heat dissipation applications in MEMS packaging, Sensors and Actuators A: Physical , 141(2) (2008) 685-694.
J. Yong Chae, B. Bharat, Biomimetic structures for fluid drag reduction in laminar and turbulent flows, Journal of Physics: Condensed Matter, 22(3) (2010) 035104.
B. Dean, B. Bhushan, Shark-skin surfaces for fluid-drag reduction in turbulent flow: a review, Philos. Trans. R. Soc. A-Math. Phys. Eng. Sci., 368(1929) (2010) 4775-4806.
F. Yang, X. Dai, C. Li, Demonstration of a Single Two-phase Flow Pattern: Annual Nanobubbles Flow Nature Communications, In revision (2012).
S. Vengallatore, Y. Peles, L.R. Arana, S.M. Spearing, Self-assembly of micro- and nanoparticles on internal micromachined silicon surfaces, Sensors and Actuators A: Physical, 113(1) (2004) 124-131.
E. Ory, H. Yuan, A. Prosperetti, S. Popinet, S. Zaleski, Growth and collapse of a vapor bubble in a narrow tube, Physics of Fluids, 12(6) (2000) 1268-1277.
D.B.R. Kenning, D.S. Wen, K.S. Das, S.K. Wilson, Confined growth of a vapour bubble in a capillary tube at initially uniform superheat: Experiments and modelling, Int. J. Heat Mass Transf., 49(23-24) (2006) 4653-4671.
H. Yuan, H.N. Oğuz, A. Prosperetti, Growth and collapse of a vapor bubble in a small tube, Int. J. Heat Mass Transf., 42(19) (1999) 3643-3657.
L.W. Florschuetz, On the mechanics of vapor bubble collapse—a theoretical and experimental investigation, University of Illinois, 1964.

(56) References Cited

OTHER PUBLICATIONS

Y. Hao, A. Prosperetti, The collapse of vapor bubbles in a spatially non-uniform flow, Int. J. Heat Mass Transf., 43(19) (2000) 3539-3550.
Z. Gao, A.M. Kennedy, D.A. Christensen, N.Y. Rapoport, Drug-loaded nano/microbubbles for combining ultrasonography and targeted chemotherapy, Ultrasonics, 48(4) (2008) 260-270.
C. Sun, E. Can, R. Dijkink, D. Lohse, A. Prosperetti, Growth and collapse of a vapour bubble in a microtube: the role of thermal effects, J. Fluid Mech., 632 (2009) 5-16.
D. R, The dynamics of vapour bubbles in nucleate boiling, Chem. Eng. Sci., 19(1) (1964) 39-49.
J.P. McHale, S.V. Garimella, Bubble nucleation characteristics in pool boiling of a wetting liquid on smooth and rough surfaces, Int. J. Multiph. Flow, 36(4) (2010) 249-260.
F. Fu, J.F. Klausner, A separated flow model for predicting two-phase pressure drop and evaporative heat transfer for vertical annular flow, International Journal of Heat and Fluid Flow, 18(6) (1997) 541-549.
W. Qu, I. Mudawar, Flow boiling heat transfer in two-phase micro-channel heat sinks—II. Annular two-phase flow model, Int. J. Heat Mass Transf., 46(15) (2003) 2773-2784.
A. Megahed, I. Hassan, Analytical Modeling of Annular Flow Boiling Heat Transfer in Mini- and Microchannel Heat Sinks, Journal of Heat Transfer, 132(4) (2010) 041012-041011.
J.G. Collier, J.R. Thome, Convective Boiling and Condensation, 3 ed., Oxford Engineering Science, 1996.
P.B. Whalley, G.F. Hewitt, P. Hutchinson, The Calculation of Critical Heat Flux in Forced Convection Boiling, Atomic Energy Research Establishment, 1973.
T. Okawa, A. Kotani, I. Kataoka, M. Naito, Prediction of Critical Heat Flux in Annular Flow Using a Film Flow Model, Journal of Nuclear Science and Technology, 40(6) (2003) 388-396.
G.B. Wallis, Flooding Velocities for Air and Water in Vertical Tubes, Reactor Development Division, Atomic Energy Establishment, 1961.
G.B. Wallis, One-dimensional two-phase flow, McGraw-Hill, 1969.
M. Kaichiro, M. Ishii, Flow regime transition criteria for upward two-phase flow in vertical tubes, Int. J. Heat Mass Transt, 27(5) (1984) 723-737.
M. Ishii, M.A. Grolmes, Inception criteria for droplet entrainment in two-phase concurrent film flow, AIChE Journal, 21(2) (1975) 308-318.
I.I. Paleev, B.S. Filippovich, Phenomena of liquid transfer in two-phase dispersed annular flow, Int. J. Heat Mass Transf., 9(10) (1966) 1089-1093.
M. Ishii, K. Mishima, Droplet entrainment correlation in annular two-phase flow, Int. J. Heat Mass Transt, 32(10) (1989) 1835-1846.
H. Utsuno, F. Kaminaga, Prediction of Liquid Film Dryout in Two-Phase Annular-Mist Flow in a Uniformly Heated Narrow Tube Development of Analytical Method under BWR Conditions, Journal of Nuclear Science and Technology, 35(9) (1998) 643-653.
T. Okawa, A. Kotani, I. Kataoka, Experiments for liquid phase mass transfer rate in annular regime for a small vertical tube, Int. J. Heat Mass Transf., 48(3-4) (2005) 585-598.
T. Okawa, T. Kitahara, K. Yoshida, T. Matsumoto, I. Kataoka, New entrainment rate correlation in annular two-phase flow applicable to wide range of flow condition, International Journal of Heat and Mass Transfer, 45(1) (2002) 87-98.
J. Ou, B. Perot, J.P. Rothstein, Laminar drag reduction in microchannels using ultrahydrophobic surfaces, Phys. Fluids, 16(12) (2004) 4635-4643.
L.B. Fore, S.G. Beus, R.C. Bauer, Interfacial friction in gas-liquid annular flow: analogies to full and transition roughness, Int. J. Multiph. Flow, 26(11) (2000) 1755-1769.
C. Cottin-Bizonne, J.-L. Banat, L. Bocquet, E. Charlaix, Low-friction flows of liquid at nanopatterned interfaces, Nat Mater, 2(4) (2003) 237-240.
J. Davies, D. Maynes, B.W. Webb, B. Woolford, Laminar flow in a microchannel with superhydrophobic walls exhibiting transverse ribs, Phys. Fluids, 18(8) (2006).
N.J. Shirtcliffe, G. McHale, M.I. Newton, Y. Zhang, Superhydrophobic Copper Tubes with Possible Flow Enhancement and Drag Reduction, ACS Appl. Mater. Interfaces, 1(6) (2009) 1316-1323.
E. Bonaccurso, H.J. Butt, V.S.J. Craig, Surface roughness and hydrodynamic boundary slip of a newtonian fluid in a completely wetting system, Phys. Rev. Lett., 90(14) (2003).
R. Chen, M.C. Lu, V. Srinivasan, Z. Wang, H.H. Cho, A. Majumdar, Nanowires for enhanced boiling heat transfer, Nano Letters, 9(2) (2009) 548-553.
P.F. Vassallo, R. Kumar, Liquid and gas velocity measurements using LDV in air-water duct flow, Exp. Therm. Fluid Sci., 19(2) (1999) 85-92.
Y. Peles, Contemporary Perspectives on Flow Instabilities in Microchannels, Begell House Inc., 2012.

* cited by examiner

ULTRA-EFFICIENT TWO-PHASE EVAPORATORS/BOILERS ENABLED BY NANOTIP-INDUCED BOUNDARY LAYERS

PRIORITY INFORMATION

The present application claims priority to U.S. Provisional Patent Application Ser. No. 61/855,494 titled "Ultra-efficient Two-phase Evaporators/Boilers Enabled by Nano-tip-Induced Boundary Layers" of Li, et al. filed on May 16, 2013, the disclosure of which is incorporated by reference herein.

GOVERNMENT SUPPORT CLAUSE

This invention was made with government support under 1336443 awarded by the National Science Foundation. The government has certain rights in the invention.

BACKGROUND

Boundary layer, a revolutionary approach to simplify the Navier-Stokes equations of fluid flow along a solid surface into two distinctively viscous and inviscid domains, was first proposed in 1904 by Ludwig Prandtl, the father of modern aerodynamics. The boundary layer plays a critical role in determining transport behaviors and hence performances. As such, directly engineering the boundary layer has been recently demonstrated to be effective in achieving unprecedented flight performance. Moreover, during flow boiling in microchannels, the boundary layer governs bubble dynamics (i.e., bubble generation, departure, and interactions) and therefore the two-phase flow and heat transfer behaviors. Thus, favorably manipulating or even controlling the boundary layer might be a promising strategy to drastically enhance flow boiling in microchannels. Unlike the boundary layer in a single-phase flow that can be predicted by Navier-Stokes equations, the boundary layer behaviors in the multi-phase flow are complex and hence extremely challenging to predict and manage.

Two-phase transport in microchannels over the last decade has been extensively studied because of its great importance in microfluidic devices, compact heat exchangers, proton exchange membrane (PEM) fuel cells, and thermal management of high power electronics. In those microsystems with the hydraulic diameter at O (100 μm), the complexity of the boundary layer structure is further exacerbated. Distinct from regular-sized systems, rapidly growing bubbles (as high as 3.5 m/s or 3500 μm/ms) in conventional microchannels will be quickly confined, resulting in Taylor flow in which the liquid is separated by Taylor bubbles (or vapor slugs). With the increase of vapor/gas superficial velocity, the interactions between vapor and liquid flows become more complicated, leading to multiple two-phase flow regimes followed by flow regime transitions. Thus, the development of the boundary layer in two-phase flow is discontinuous and highly dependent on flow regimes. Moreover, during flow boiling in microchannels, Taylor bubbles are subject to a highly non-uniform temperature field, therefore prone to sustaining in a quasi-equilibrium state if not properly managed. These Taylor bubbles can lead to vapor ingestion, flow crisis or even two-phase flow instabilities during flow boiling in conventional microchannels. Equally important, during flow boiling, the confined bubbles can create relatively large dry areas (i.e., the direct contact areas between vapor and walls) on walls with high surface tension fluids such as water and consequently, hinder heat transfer rate and cause premature critical heat flux (CHF) conditions. In addition, if not effectively managed, flow boiling in conventional microchannels is also susceptible with laminar and capillary flow in most typical working conditions with Reynolds number at O (100).

Numerous techniques have been designed to enhance flow boiling in microchannels. These include inlet restrictors (IRs) or orifices to manage reverse flows, seed bubbles to improve thermal equilibrium, impingement and synthetic jets to actively intensify mixing or induce advection, and artificial nucleation cavities such as microfabricated reentry cavities, microcoatings, and nanocoatings to promote nucleate boiling. Most recently, a self-excited and modulated high frequency two-phase oscillation mechanism that allows for passive collapse of confined bubbles inside microchannels has been developed to enhance flow boiling (See e.g., U.S. patent application Ser. No. 13/828,701 of Li, et al. titled "Enhanced Flow Boiling in Microchannels by High Frequency Microbubble-Excited and—Modulated Oscillations" and published as U.S. Publication No. 2014/0027005, which is incorporated by reference herein). The concept to enhance flow boiling heat transfer by separating two phase flows in regular-sized channels and microchannels has been eleganetly achieved. Textured superhydrophobic boiling surfaces was also reported to effectively manipulate nucleate boiling by suppressing film boiling.

Nonetheless, multiphase transport in microchannels remains essential for a wide range of emerging technologies such as microfluidics, direct cooling of high power electronics, and water management in fuel cells. Despite extensive progress over the past decade, it remains challenging to achieve exceptional flow boiling enhancements in microchannels due to unfavorable size effects such as bubble confinement and exacerbated flow instabilities. Since the performances of multiphase transport are intrinsically governed by the boundary layer, the ability to favorably manipulate or even control the boundary layer is strongly desired. Radically different from the single-phase flow in conventional microchannels in which the boundary layer is typically laminar, however, the boundary layer behaviors in the multiphase flow are highly stochastic and transitional, thus extremely difficult to predict and manage.

Furthermore, interest in two-phase transport in microfluidic systems has been rapidly growing because of its wide range of applications in diverse scientific and engineering disciplines including biology, chemistry, and thermal management. For an example, the continuous advances in integrated circuits (ICs) technology has led to unprecedented cooling needs with heat fluxes ranging from approximately 100 W/cm$^2$ in current electronic microchips to 2000 W/cm$^2$ in semiconductor lasers. Dissipating such high heat fluxes with requirements in the temperature uniformity and integration (or compactness) has imposed practical limits on traditional air and single-phase liquid cooling technologies. With the potential to be embedded in microchips, heat transfer in microchannels, has been an active research area ever since the ground-breaking work of Tuckerman and Pease in 1981, which demonstrated the potential of microchannels to dissipate high heat fluxes.

Compared to single-phase transport in microchannels, flow boiling has several key beneficial characteristics. These characteristics include improved temperature uniformity, i.e., lower temperature difference between inlet and outlet, and reduced pumping power due to the latent heat evaporation. The classic two-phase flow patterns, primarily including bubbly flow, slug flow, churn flow and annular flow, carry some unique traits at the micro scale. Because two-phase flow pattern transitions in conventional microchannels are challenging to predict, often transport processes at the micro scale are not designed properly, which in turn, hinders performance and can cause severe two-phase flow instabilities.

More particularly, flow boiling in miniaturized channels has been extensively studied in the last decade. Tremendous progresses have been made in understanding transport mechanisms in heat transfer, two-phase flow instabilities, and critical heat flux (CHF). The prior related work can be classified on several axes, as described below.

In small scale channels, the confinement of the bubble introduces one type of noticeable instabilities termed the rapid bubble growth. This often reported rapid growth of bubbles in the bubbly flow regime in microchannel systems is characterized by high departure frequencies on the order of f=O (10-1000 Hz). In the initial stage of the nucleation cycle, a spherical bubble grows until it attains a size comparable to the channel hydraulic diameter. The bubble then grows rapidly in the longitudinal direction (downstream as well as upstream) causing flow reversal. This, in turn, introduces appreciable disturbances to the flow, and in many cases prematurely triggers other instability modes, such as Ledinegg instability, upstream compressible flow instability, and CHF conditions.

Extensive studies have been conducted in two-phase flow instabilities in microchannels in the last decades. These methods include modifying IRs, improving nucleate boiling, reducing the influence of the surface tensions, creating diverging channel cross-section configurations, and applying micro-jets. Most recently, microfluidic transistors have been developed to enable a self-sustained high frequency two-phase oscillation mechanism and successfully applied it to enhance flow boiling in microchannels. To date, IRs has been found to be the most effective way to suppress Ledinegg instability. However, they introduce dramatic increase in the pressure drop. Additionally, low heat transfer rate results from adding surfactants, and challenges persist in arranging micro-nozzles and compressors when using micro-jets.

In the latest critical reviews on flow boiling in microchannels, it has been demonstrated that flow boiling HTC curves for microchannels are "M" shaped or "U" shaped when varying with thermodynamic equilibrium quality. The downturn of the HTC curve is caused by the confined bubbles (or vapor slugs), where thin film evaporation occurs near the small liquid bridge area; while large wall area within the confined bubbles are devoid of liquid.

It is more challenging to enhance convective flow boiling in microchannels. This is because most operating conditions are laminar. Micro jet arrays have been demonstrated to effectively enhance the boiling process, but the packaging of the impingement jet is still challenging due to the jets arrangement, the flow distribution management and availability of a proper compressor. To enhance nucleate boiling and improve thin film evaporation is another strategy to enhance flow boiling by integrating artificial nucleation cavities and nanowires into microchannels. These include microfabricated reentry cavities, microcoatings, nanocoatings, etc. To date, two-phase flows in miniaturized channels are still limited by bubble confinements, laminar and capillary flows, which result in unpredictable flow pattern transitions and tend to induce severe two-phase flow instabilities and suppress evaporation and convection. This, in turn, is detrimental to heat transfer. As a result, two-phase cooling has not been accepted as a practical approach for electronics cooling.

Compared to single-phase cooling in microchannels, through the latent heat evaporation, flow boiling has great potentials in achieving high temperature uniformity (i.e., low temperature difference between inlet and outlet) at a high working heat flux with a reduced pumping power. Recent studies demonstrated that novel configurations, such as microfluidic transistors, inlet restrictors (IRs) or valves/orifices, artificial cavities, and impingement jets, can suppress boiling instabilities and enhance several key flow boiling parameters including onset of nucleate boiling (ONB), heat transfer coefficient (HTC), and critical heat flux (CHF) conditions. However, flow boiling in miniaturized channels is hampered by several severe constraints such as bubble confinements, viscosity and surface tension force-dominated flows, which result in unpredictable flow pattern transitions and tend to induce severe two-phase flow instabilities and suppress evaporation and convection. This, in turn, is detrimental to flow boiling heat transfer.

As stated, heat and mass transfer are ultimately governed by boundary layers (BLs) during flow boiling in microchannels. It was experimentally demonstrated in recent studies that flow boiling can be enhanced by disturbing BLs through creating oscillations, introducing capillary flows along walls, and promoting thin film evaporation.

However, research to enhance flow boiling in microchannels by intentionally constructing and optimizing BLs has not been reported.

SUMMARY

Objects and advantages of the invention will be set forth in part in the following description, or may be obvious from the description, or may be learned through practice of the invention.

Microfluidic devices are generally provided, along with methods of their fabrication. In one embodiment, the microfluidic device includes a substrate defining a microchannel formed between a pair of side walls and a bottom surface and a plurality of nanotips positioned within the microchannel and proximate to each side wall such that a boundary layer is formed along each side wall between the plurality of nanotips and the side wall upon addition of a liquid into the microchannel.

A diameter is generally defined in the microchannel that measures the shortest distance between the side walls. In a particular embodiment, each nanotip can define an average pitch that is at least 20 times smaller than the diameter of the microchannel (e.g., an average pitch that is at least 10 times smaller than the diameter of the microchannel). For example, the diameter of the microchannel can be about 200 μm to about 500 μm in particular embodiments. For example, the average pitch can be about 1 μm to about 20 μm in particular embodiments The microchannel also generally defines a microgap measuring the shortest distance between an individual nanotip and a nearest sidewall. In one embodiment, the microgap can be less than 5% of the diameter of the microchannel. For example, the microgap can be about 2.5 μm to about 15 μm.

In a particular embodiment, the substrate can comprise silicon.

A glass wafer can be positioned on the substrate to enclose the microchannels.

Methods of forming microchannels having a plurality of nanotips are also generally provided.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures.

FIG. 2*a* shows a schematic where BLs are present between the wall and nanotips when a vapor slug appears and the bubble rapidly grows due to thin-film evaporation. FIG. 2*b* shows the bubble (of FIG. 2*a*) rapidly collapsing due to intensified direct condensation and high frequency rewetting flow is induced. FIG. 2*c* shows a schematic where BLs are absent between the wall and nanotips when a vapor slug grows primarily due to thermal expansion after slugs formed. FIG. 2*d* shows that the bubble (of FIG. 2*c*) shrinks because of direct condensation.

FIG. 10*a* shows comparisons of the transient water-front velocity in plain-wall and nanoengineered microchannels. In a period of liquid renewal, a high flow velocity activated by the nanotip-reconstructed boundary layer maintains between 1 m/s and 1.6 m/s. By contrast, the velocity of liquid renewal in the plain-wall microchannels cannot be sustained. It drops nearly to zero in approximately 2 ms in the rest of 4 ms till reversing flows occurred in the period. FIG. 10*b* shows a comparison of travelling distance of liquid renewal in a typical bubble growth and collapse period in plain-wall and nanoengineered microchannels. The liquid renewal can wet the entire channels, i.e., from inlet to outlet of the nanoengineered microchannels, but only one fifth of the channel length in the plain-wall microchannels. FIG. 10*c* shows a high frequency reconstruction of the liquid boundary layer in nanoengineered microchannels is plotted as a function of the working heat flux.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

As used herein, the prefix "nano" refers to the nanometer scale of about 1 nm to about 100 nm. For example, particles having an average diameter of about 1 nm to about 100 nm are referred to as "nanoparticles." Particles having an average diameter of greater than 1,000 nm (i.e., 1 μm) are generally referred to as "microparticles", since the micrometer scale generally involves those materials having an average size of greater than 1 μm.

Apparatus and methods are generally provided to achieve exceptional flow boiling enhancements through reconstructing boundary layers by harnessing the capillary effect in nanoengineered microchannels. It was demonstrated that the introduction of the unique boundary layer drastically facilitates and promotes favorable heat transfer modes, effectively manage bubble confinement and suppresses flow instabilities, thereby enabling substantially enhanced flow boiling as opposed to that in plain-wall microchannels.

By harnessing the capillary effect using superhydrophilic nanotips integrated in microchannels, the highly stochastic and transitional boundary layer behaviors in plain-wall microchannels can be rationally managed and transformed in a well-controlled manner, which overcome long-existing obstacles of two-phase flows such as bubble confinement and flow instabilities. Moreover, it was demonstrated that the realization of a favorably-controlled boundary layer can effectively regulate flow regimes by the rapidly collapsing bubbles inside inlet manifold, can facilitate and promote the favorable heat transfer modes, and can create a superior liquid supply mechanism created by the high frequency and thorough liquid renewal inside channels, and therefore allowing for exceptional flow boiling enhancements in the nanoengineered microchannels.

Figure 1A:
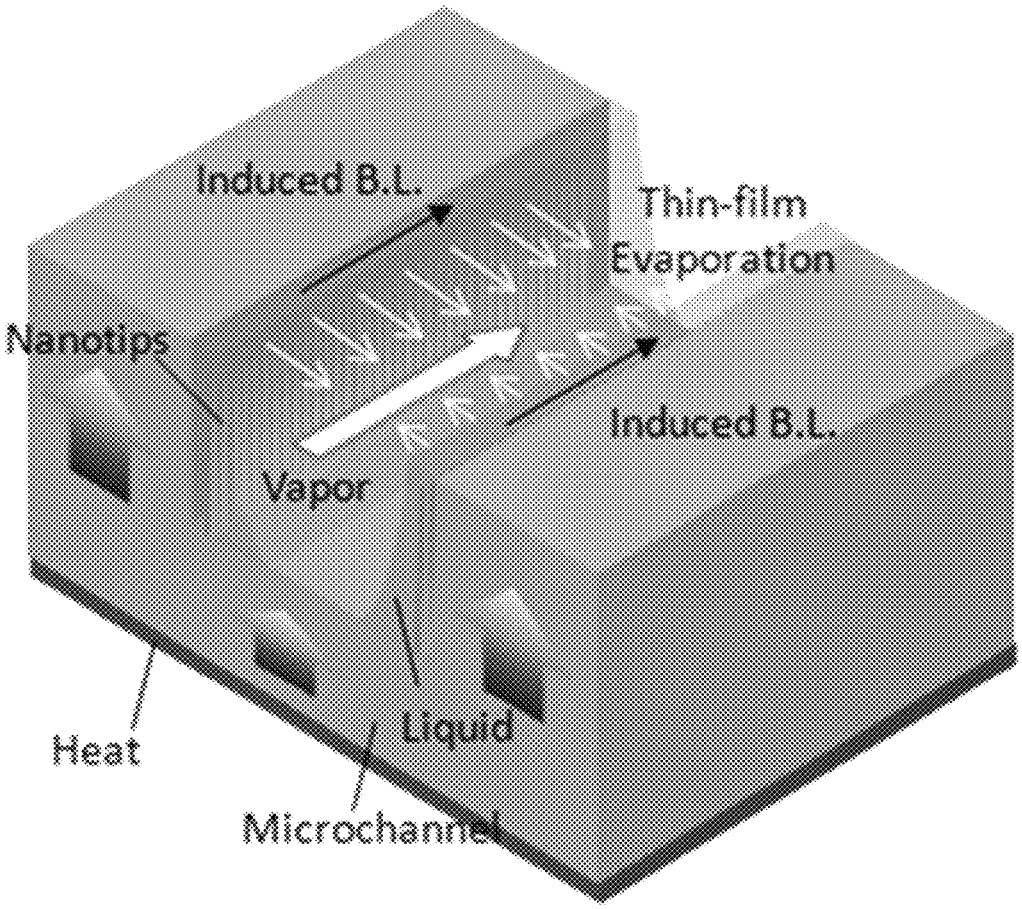
FIG. 1*a* shows a general schematic of one exemplary embodiment of nanotips induced boundary layers to enhance flow boiling in microchannels.
Figure 2A:
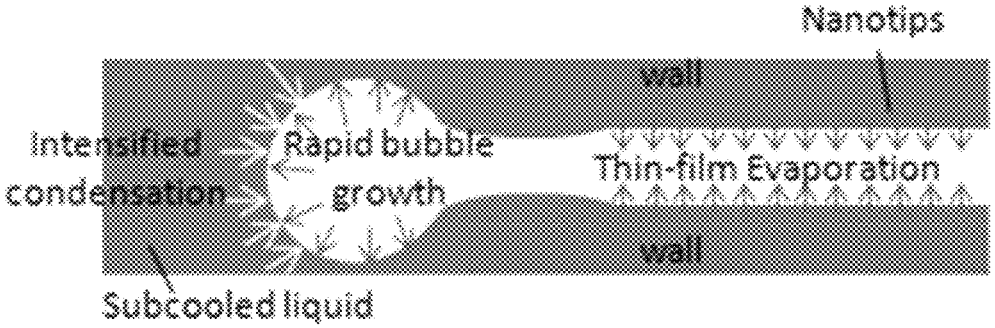
FIGS. 2*a*-2*d* shows formation of exemplary nanotips induced BL in microchannels and bubble dynamics in microchannels with and without induced boundary layers.
Figure 2B:
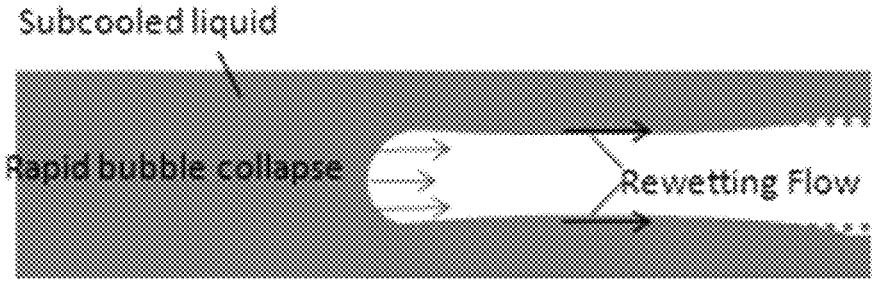

A hydrophilic nanotip array is shown in FIG. 1*a*, which is designed and fabricated along each vertical wall inside microchannels by deep reactive ion etching (DRIE) with a distance of several micrometers. Once the liquid-vapor interface is established adjacent to nanotips during the boiling process, the BL can be formed between the wall and nanotips as schematically illustrated in FIGS. 2*a* and 2*b* because of the surface tension force. It should be noted that the IRs, the most effective configurations in suppress flow boiling instabilities in parallel channels, are not required.

The established BL fundamentally alters the heat transfer and two-phase flow behaviors during flow boiling in microchannels. For examples, the elongated bubble grows more rapidly as a result of the efficient vapor generation from the thin film evaporation on the induced BL (FIG. 2*a*). Consequently, the rapid growth of a bubble leads to significantly enhanced direct contact condensation heat transfer at the subcooled liquid and vapor interface and hence, a rapid collapse of a vapor slug (FIG. 2*b*). The rapid and periodic growth and collapse of a vapor slug in microchannels leads to high frequency liquid flush inside microchannels during flow boiling. Such a highly dynamic fluid motion induced by nanotips is highly desirable and was not achieved before. The high frequency oscillations can drastically enhance the global and local liquid supply and introduce advections. The existence of the induced BL, i.e., a moving liquid film (because of the surface tension force and shearing stress imposed by vapor flows), can reduce the transitional flow regimes into a new regime similar with annular flow by separating liquid and vapor flows.

Figure 2C:
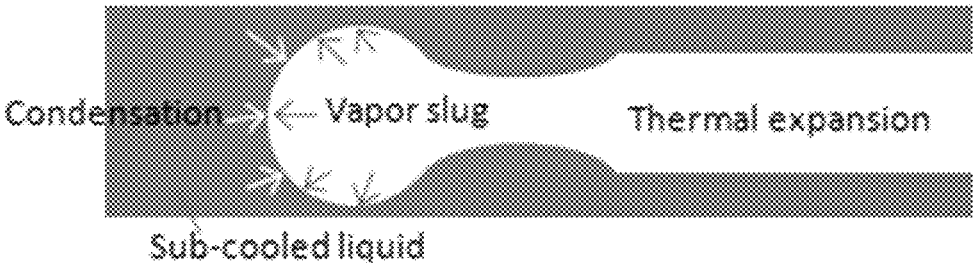
Figure 2D:
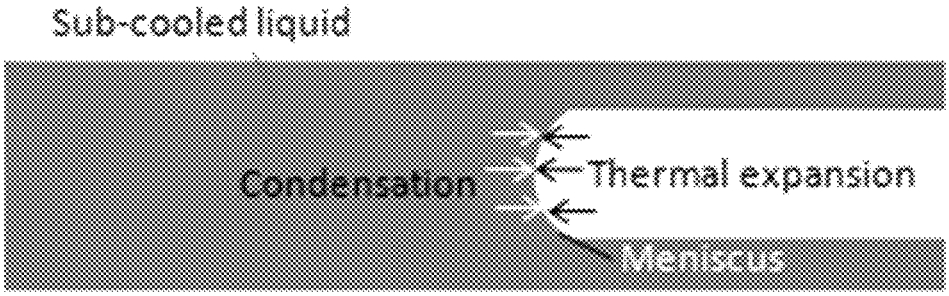

On the contrary, the bubble behaviors in microchannels with only plain wall are radically different as schematically shown in FIGS. 2*c* and 2*d*. Without the induced boundary layer, the bubble growth rate primarily determined by the thermal expansion is limited (FIG. 2*c*), which results in low condensation rate between the subcooled fluid and hence low frequency bubble expanding and shrinking process (also known as flow boiling instabilities). The surface tension force generated in the cross-sectional direction of a microchannel prevents liquid supply to wall and causes premature CHF conditions.

By directly reconstructing the BL, it has been shown that the flow boiling in microchannels can be controlled and designed as desired to some extent. As a result, CHF can be dramatically enhanced up to nearly 500% by creating new liquid supply mechanisms without using the IRs. The unpredictable two-phase flow patterns can be reduced to a new and single flow pattern enabling excellent controllability of the otherwise stochastic two-phase flow patterns/regimes. Equally important, the extremely challenging task to develop general, physics-based and robust two-phase models to accurately predict two-phase transport in conventional microchannels could be accomplished in a unified two-phase regime that is enabled by nanotips induced BLs.

Flow boiling has great potential in cooling high power electronic and photonic components. The device performance is often thermally limited due to the limitation of current cooling technologies. However, two-phase flows in microchannels are still limited by unpredictable flow pattern transitions and two-phase flow instabilities. This, in turn, is detrimental to heat transfer. As a result, two-phase microchannels have not been accepted as a practical approach for electronics cooling.

Compared with the partial and incremental enhancement of flow boiling in existing studies through the use of novel configurations, flow boiling in microchannels with nanotips induced BLs could be drastically enhanced by optimizing the heat transfer process and two-phase flows. Such a dramatic enhancement in the flow boiling can lead to a breakthrough in the design of energy-efficient and cost-effective two-phase cooling systems to achieve direct cooling of next generation high power electronics, 3D microelectronics, and high power photonics.

The major outcomes of nanotips induced BLs on flow boiling in microchannels can be summarized in fourfold:

Altered Flow Boiling Regimes:

Flow boiling regimes can be altered and even reduced since the direction of the dominant surface tension force will be transformed from cross-sectional plane to inner-wall plane. The liquid and vapor flows can be separated by the induced BL.

Enhanced Heat Transfer Coefficient (HTC):

Boiling heat transfer in microchannels is limited by bubble confinements, surface tension force and viscous dominant flows. The former factor results in severe two-phase flow instabilities, which can lead to premature CHF conditions; the latter two limits the internal convection contribution in terms of liquid supply and heat transfer rate during flow boiling. By inducing BL, the confined bubbles can be collapsed at a high frequency and positively utilized to radically overcome the limit of liquid supply imposed by flow boiling instabilities as well as to generate strong advections, which are challenging to be passively activated in microchannels. As a result, the heat transfer coefficient will be drastically enhanced as a result of the collective effect because of the thin-film evaporation on the induced BL, advections resulting from the high frequency rewetting, and improved nucleate boiling on artificial cavities created by nanotips.

Enhanced Critical Heat Flux (CHF):

CHF can be dramatically enhanced because of the establishment of a superior liquid supply mechanism that is created by the induced BL at global and local levels. Specifically, the global liquid supply would be greatly improved by high frequency bubble growth and collapse process; while the induced capillary flow by nanotips drastically improves the local liquid supply.

Reduced Pressure Drop ($\Delta p$):

Pressure drop can be well managed because of the separation of liquid and vapor flows and the lubrication effect of induced boundary layer. Since IRs are not required, the pressure drop in microchannels with nanotips induced BL can be dramatically reduced compared the microchannels with IRs. The pressure drop could be further reduced to be less than traditional microchannels with smooth walls with proper design of BL profiles.

Example 1

A preliminary experimental study was performed on flow boiling in Si microchannels having five parallel channels (length, width, and depth: 10 mm, 200 μm, and 250 μm) with Si nanotips induced BL. For comparisons, a parallel microchannel array with identical channel dimensions was tested.

Figure 3A:
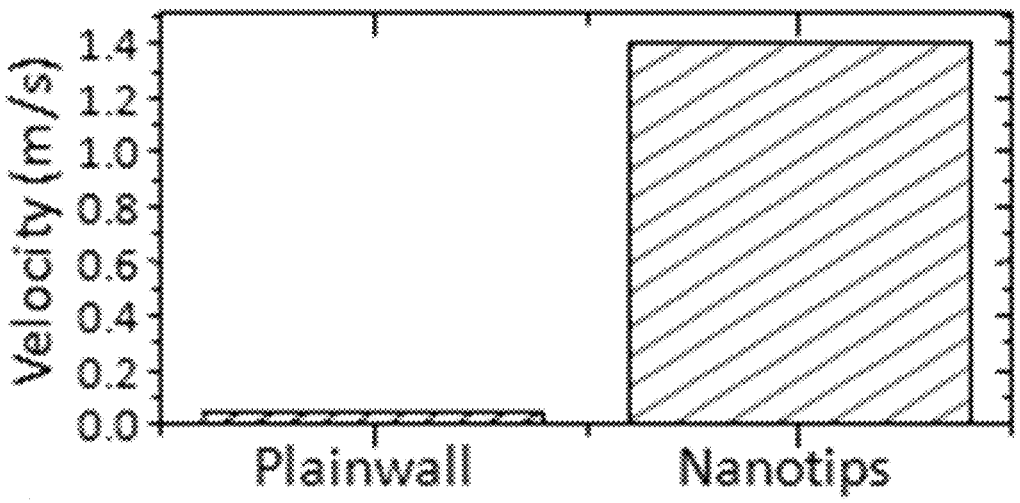
FIGS. 3*a* and 3*b* shows preliminary results of bubble expansion rate and rewetting frequency during flow boiling with nanotips-induced BL, with FIG. 3*a* showing the averaged velocity of the liquid-vapor interface during bubble expansion and FIG. 3*b* showing the frequency of rewetting induced by nanotips.
Figure 3B:
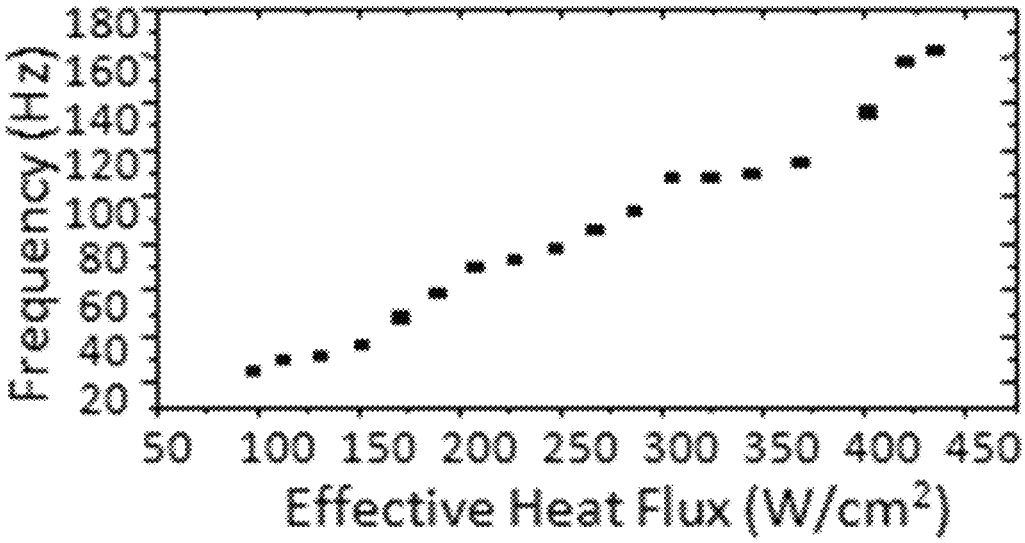

The impacts of nanotips induced BL were accessed. Specifically, the averaged velocity of the liquid-vapor interface during bubble expansion was used to measure the bubble expansion rate by assuming a constant cross-sectional flow area. As illustrated in FIG. 3*a*, the velocity in the microchannels with induced BL was approximately an order of magnitude higher that in microchannels with smooth walls. The rapid rewetting induced by nanotips was also observed in the preliminary study as illustrated in FIG. 3*b*. The rewetting frequency was measured ranging from 35 Hz to 180 Hz and observed to increase with increasing working heat flux.

Figure 4A:
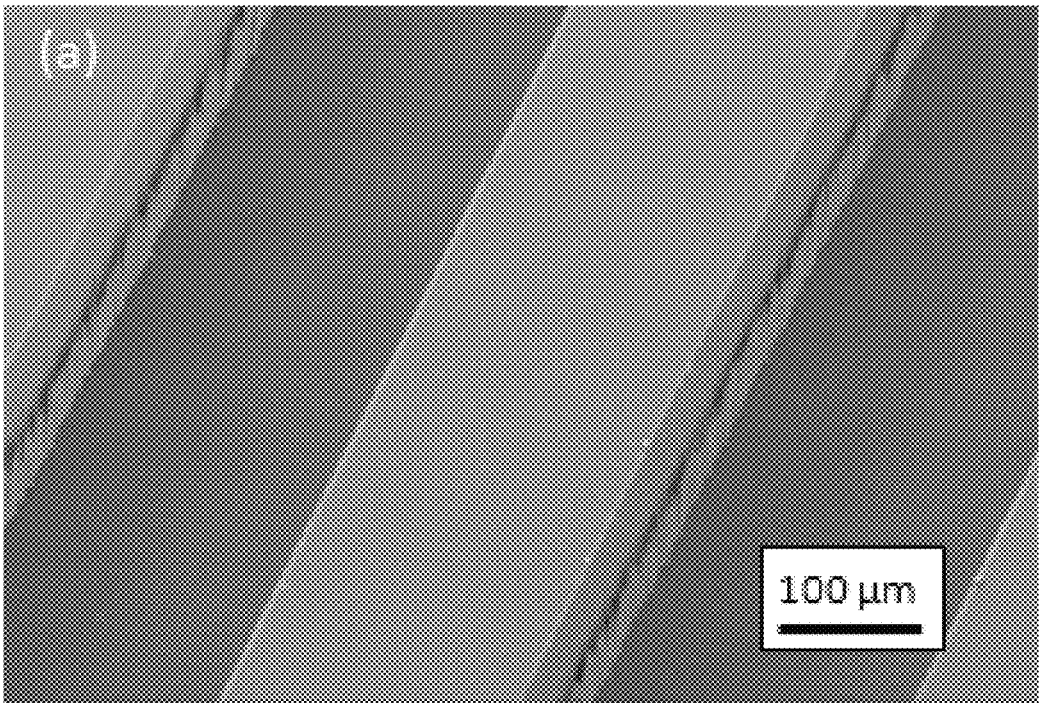
FIGS. 4*a*-4*c* show SEM images of nanotips inside microchannels, with FIG. 4*a* showing an overview of microchannels with nanotips, FIG. 4*b* showing nanotips adjacent to vertical walls, and FIG. 4*c* showing a close-look of the nanotips of FIG. 4*b*.
Figure 4B:
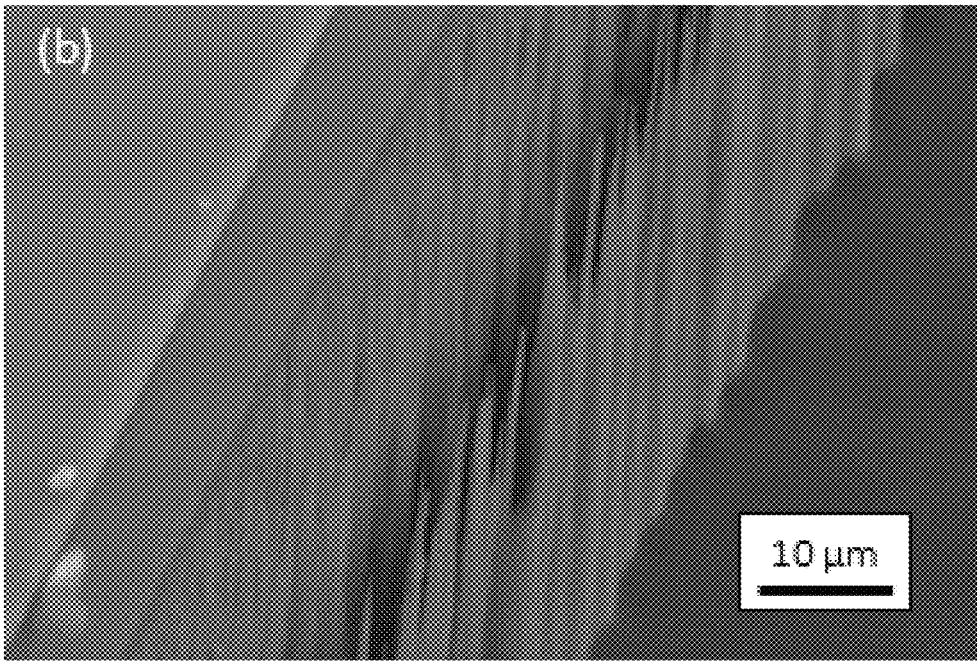
Figure 4C:
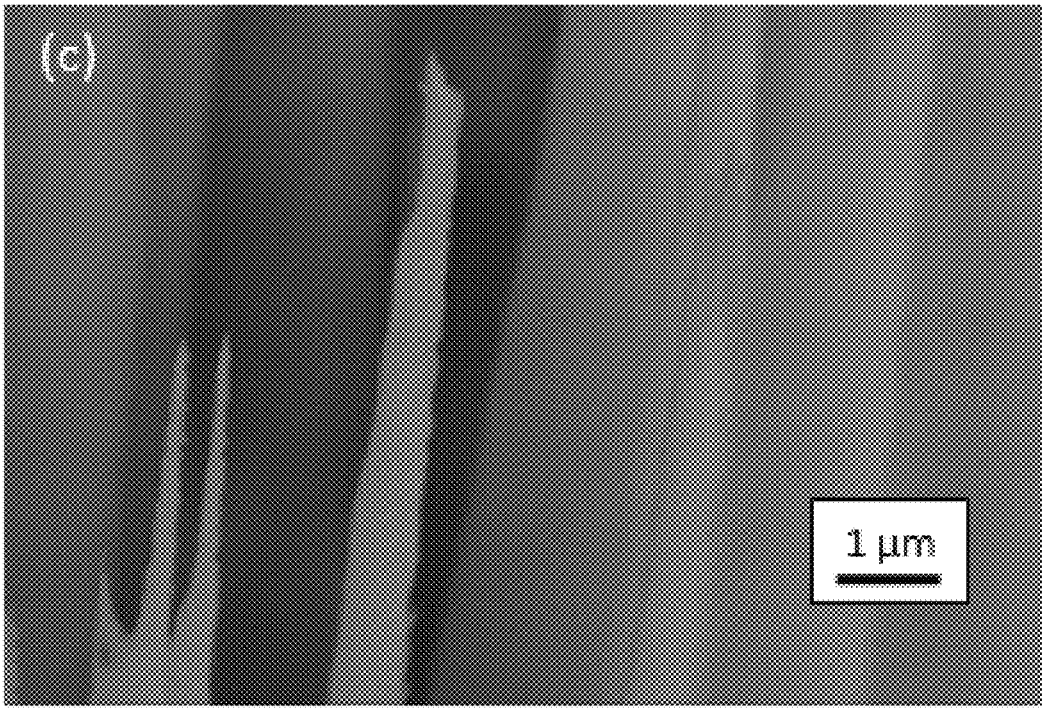
Figure 4D:
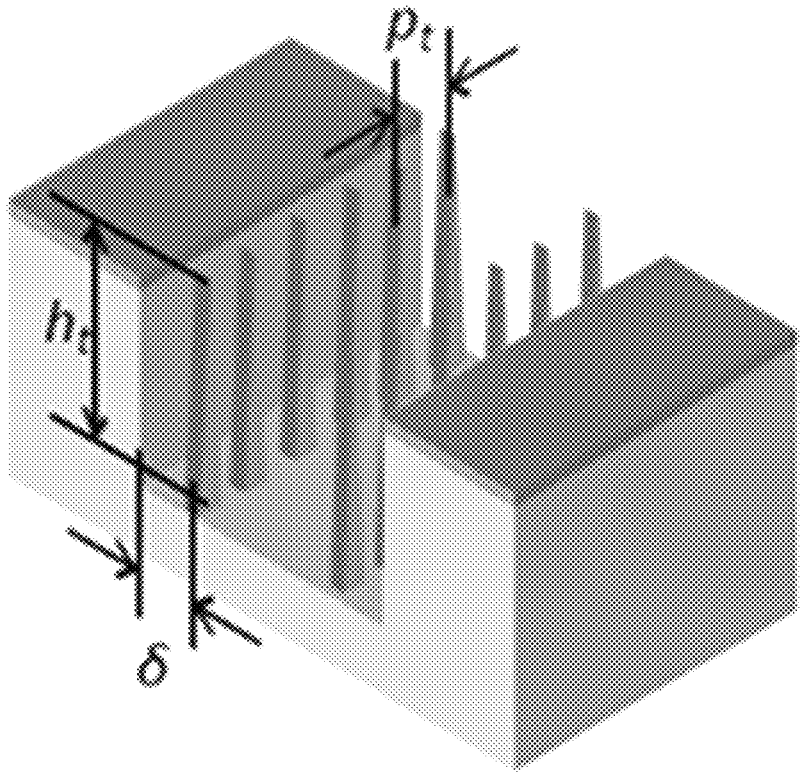
FIG. 4*d* shows a general schematic of the nanotips with the various 3D dimensions defined.

In order to verify the nanotips fabrication technique, a preliminary experimental study on flow boiling in Si microchannels having five parallel channels (length, width, and depth: 10 mm, 200 μm, and 250 μm) with Si nanotips (FIG. 4*a*). The dimensions of the nanotips were, with respect to the schematic of FIG. 4*d*, $h_t$ being about 200 μm Table 1, δ being about 5, and $p_t$ being about 5. Deionized (DI) water was the working fluid. Major results of significantly enhanced flow boiling are summarized in FIGS. 5*a*-5*c*.

Figure 5A:
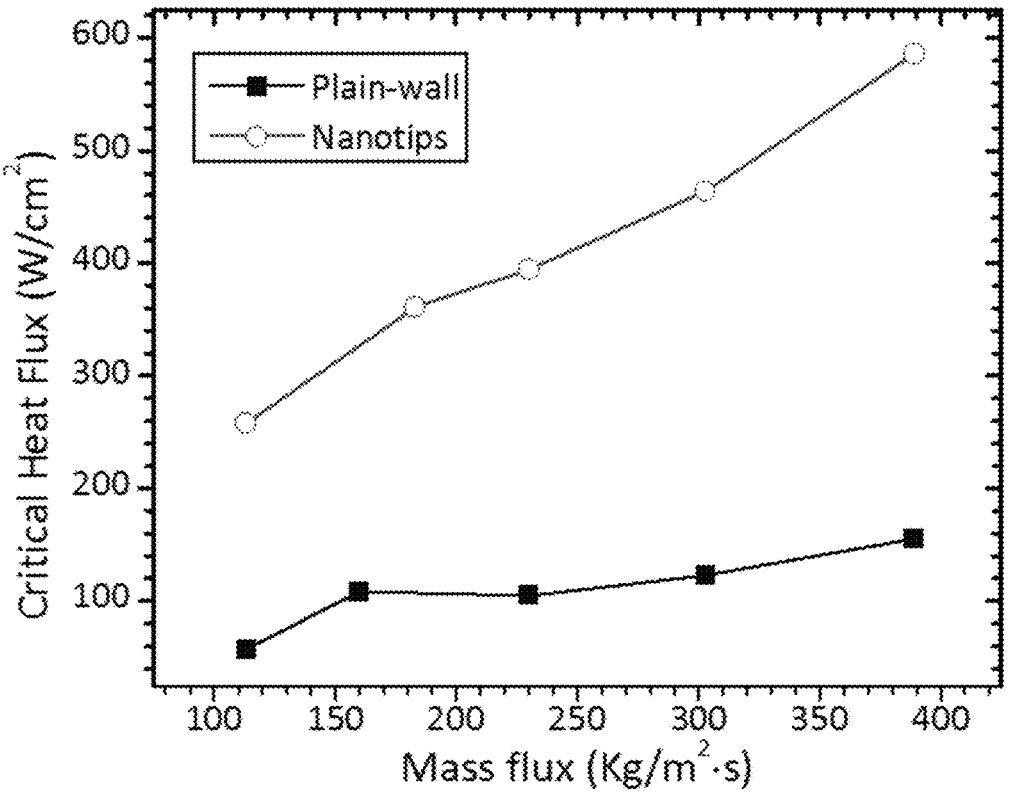
FIGS. 5*a*-5*c* show enhanced flow boiling by nanotips-induced BL, with FIG. 5*a* showing enhanced CHF, FIG. 5*b* showing enhanced HTC, and FIG. 5*c* showing a Δp-G map of flow boiling in microchannels with inlet orifice and nanotips.

Enhanced CHF:

As shown in FIG. 5*a*, CHF was enhanced up to ~585 W/cm$^2$ at a moderate mass flux of 389 kg/m$^2$·s on DI water. Compared to flow boiling in microchannels with smooth walls, enhancement of CHF was enhanced up to 448%.

Figure 5B:
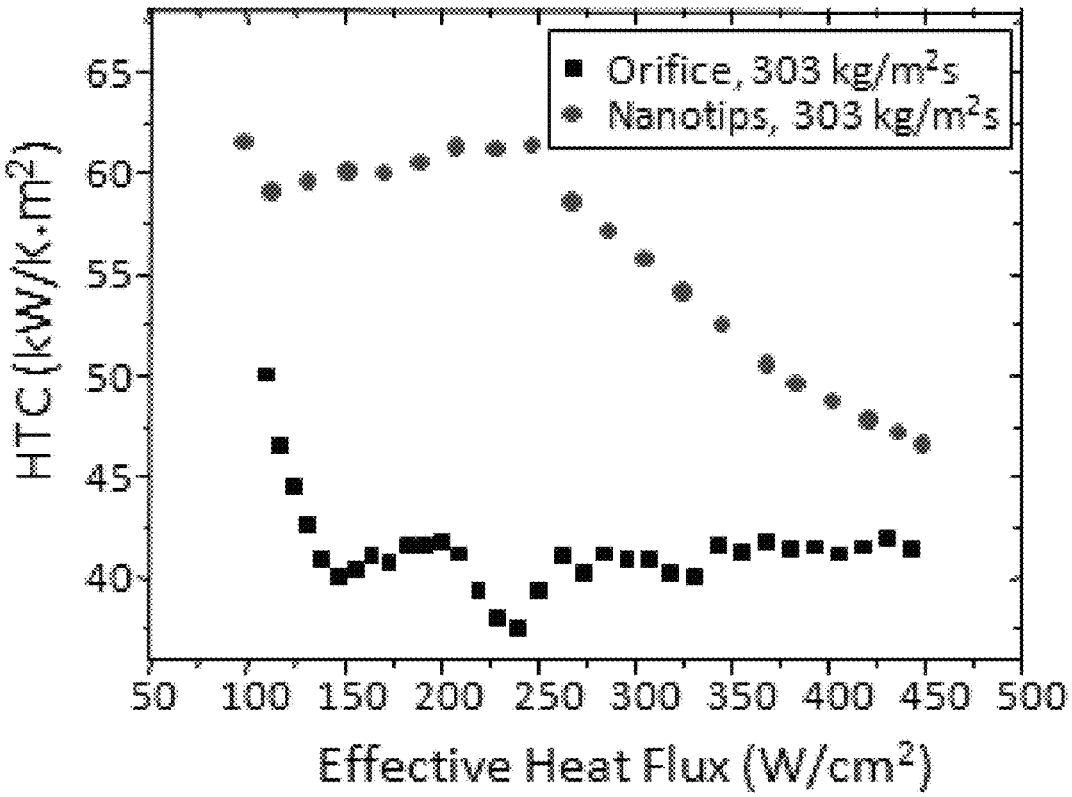

Enhanced Heat Transfer Coefficient:

Since flow boiling in microchannels with plain walls cannot work at high heat flux due to the premature CHF condition, microchannels with IRs was used as a baseline to demonstrate the heat transfer enhancement resulting from the proposed concept. As illustrated in FIG. 5*b*, approximately 50% enhancement in HTC was experimentally demonstrated.

Figure 5C:
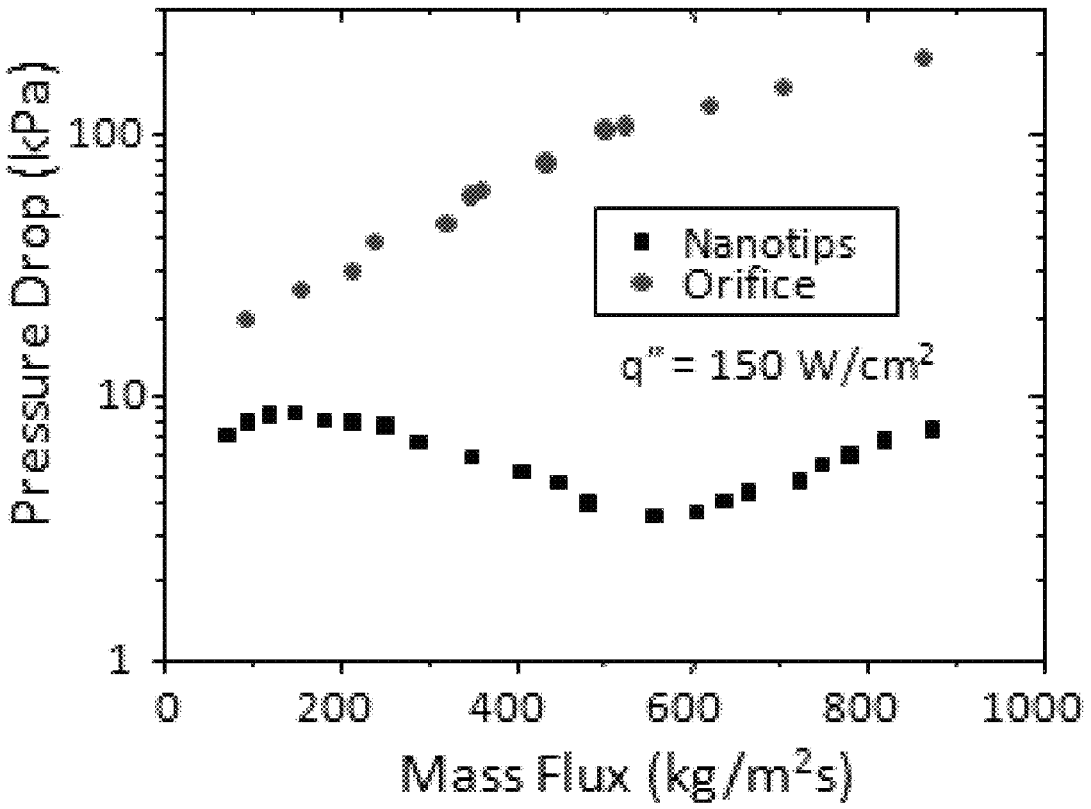

Manageable Pressure Drop:

Pressure drop in microchannels with IRs and nanotips was compared in FIG. 5*c*. As shown, the reduction in the pressure drop in microchannels with nanotips is up to 93% compared with microchannels with IRs. It was well illustrated (in FIG. 5*a* and FIG. 6 that suppressed flow boiling instabilities was achieved as effectively as IRs, without escalating pressure drop.

Figure 6A:
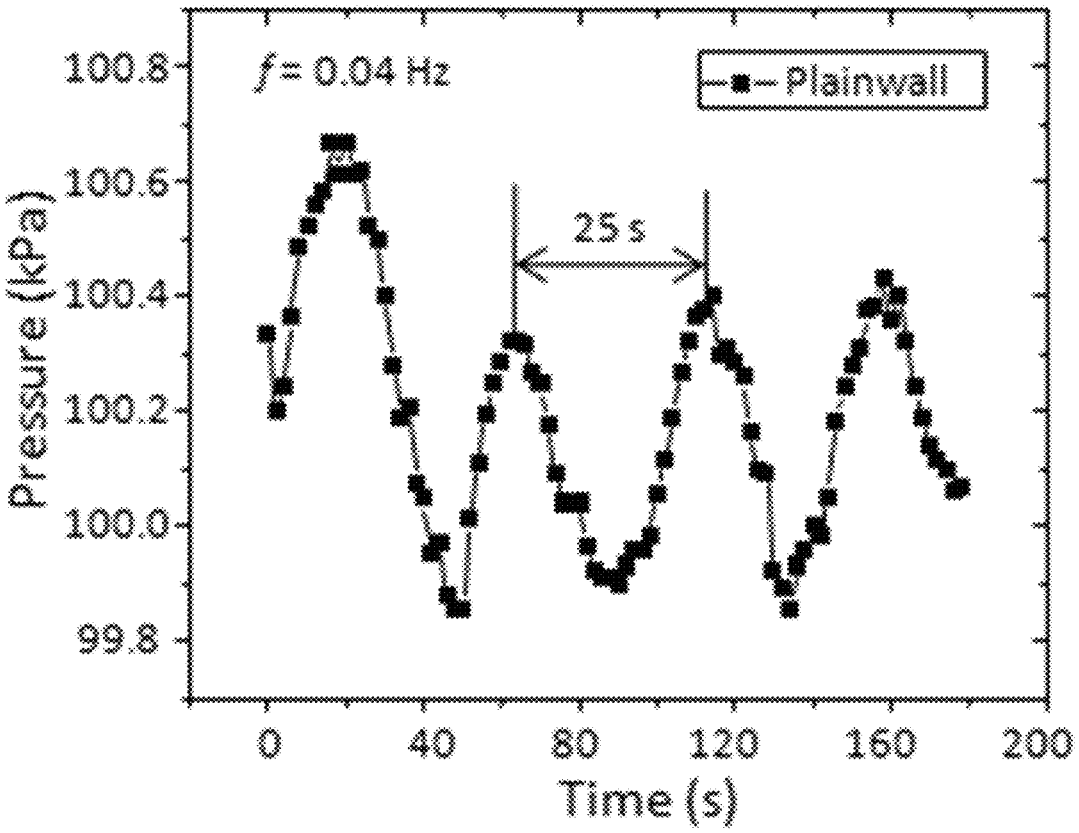
FIGS. 6*a*-6*d* show the stabilized flow boiling by nanotips induced BL, with FIG. 6*a* showing oscillations of outlet pressure during flow boiling in plain-wall microchannels at a mass flux 230 kg/m$^2$ s and a heat flux of 125 W/cm$^2$, FIG. 6*b* showing oscillations of outlet pressure during flow boiling in microchannels with nanotips induced BL at a mass flux 230 kg/m$^2$ s and a heat flux of 125 W/cm$^2$, FIG. 6*c* showing oscillations of the mass flux in microchannels at a mass flux 230 kg/m$^2$ s and a heat flux of 125 W/cm$^2$, and FIG. 6*d* showing oscillations of the wall temperature in microchannels at a mass flux 113 kg/m$^2$ s and a heat flux of 53 W/cm$^2$.
Figure 6B:
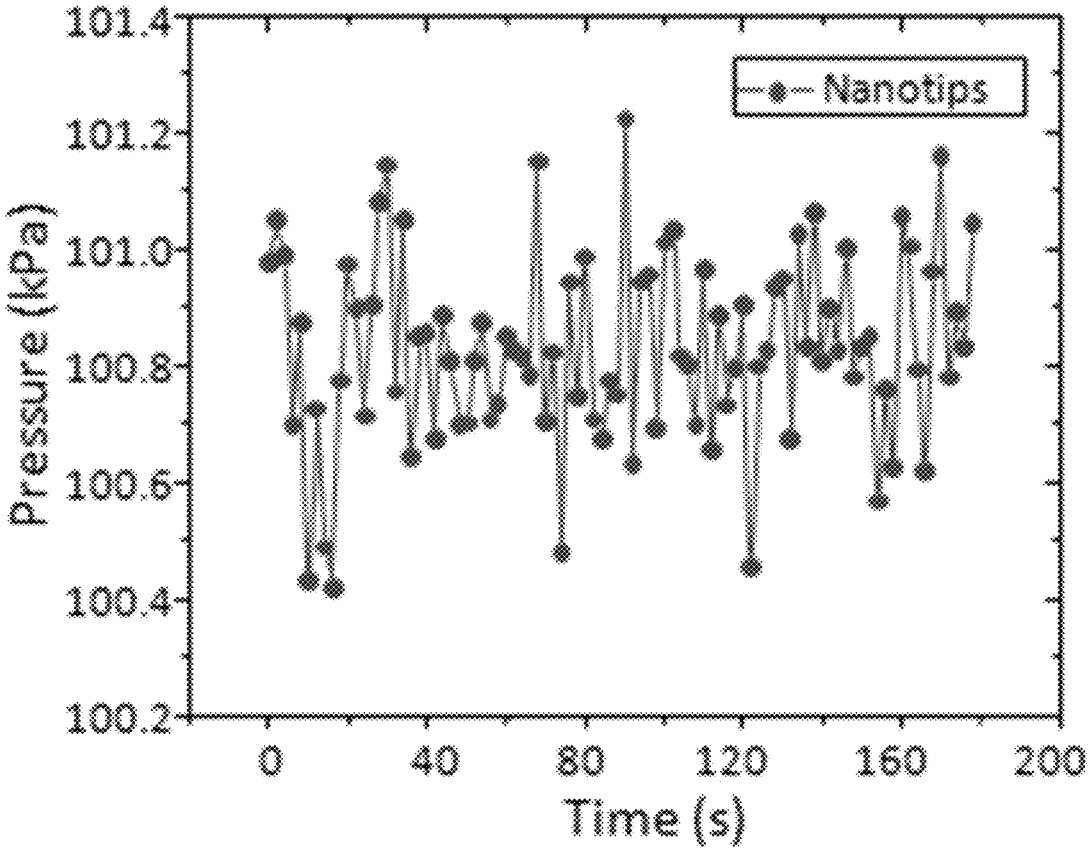
Figure 6C:
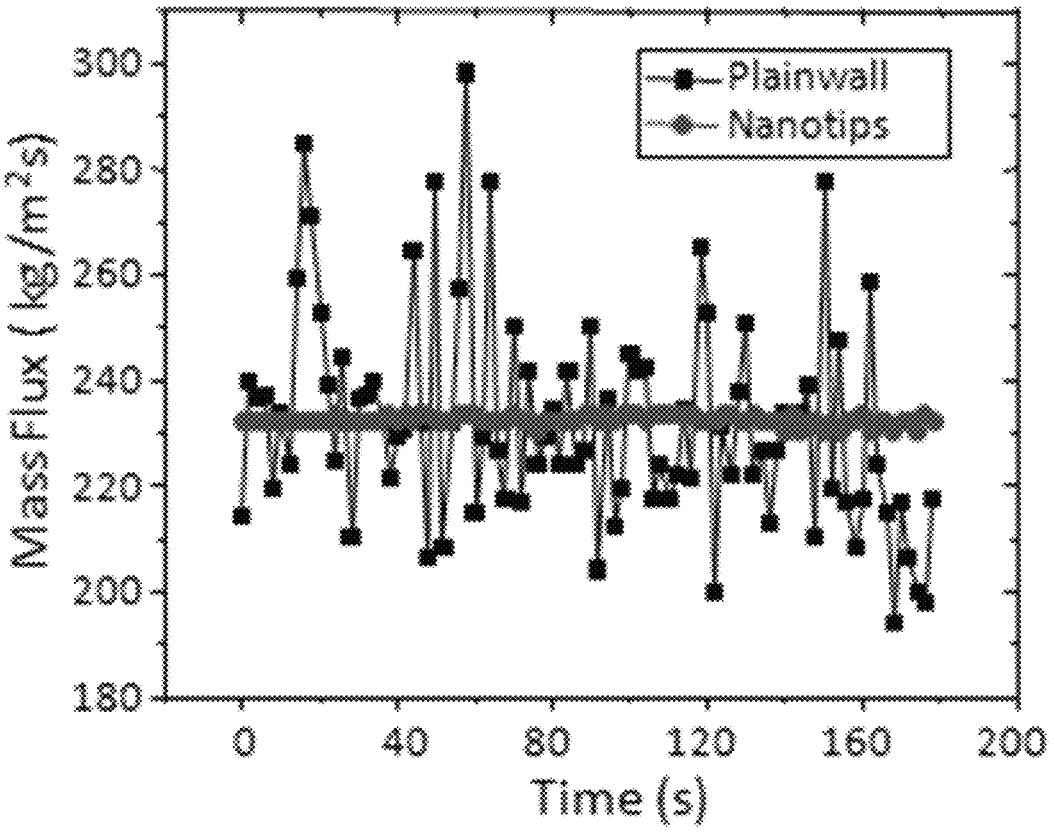
Figure 6D:
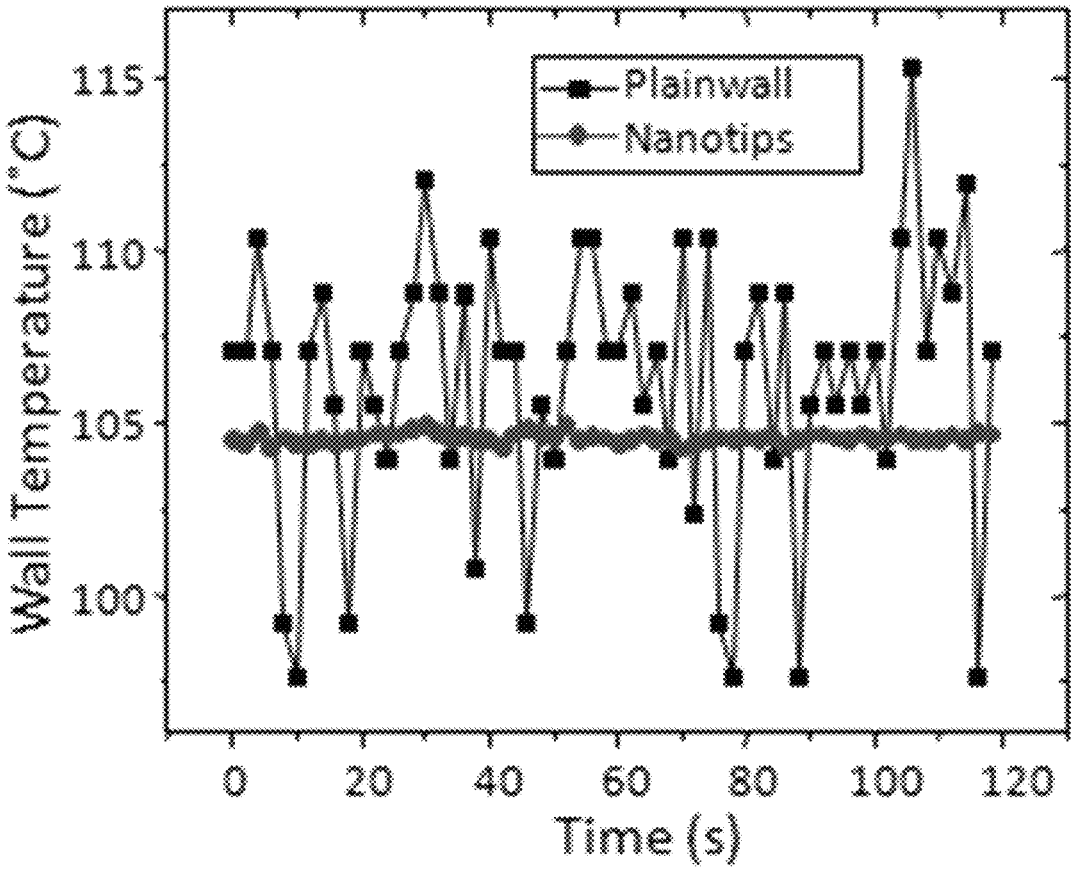
Figure 7:
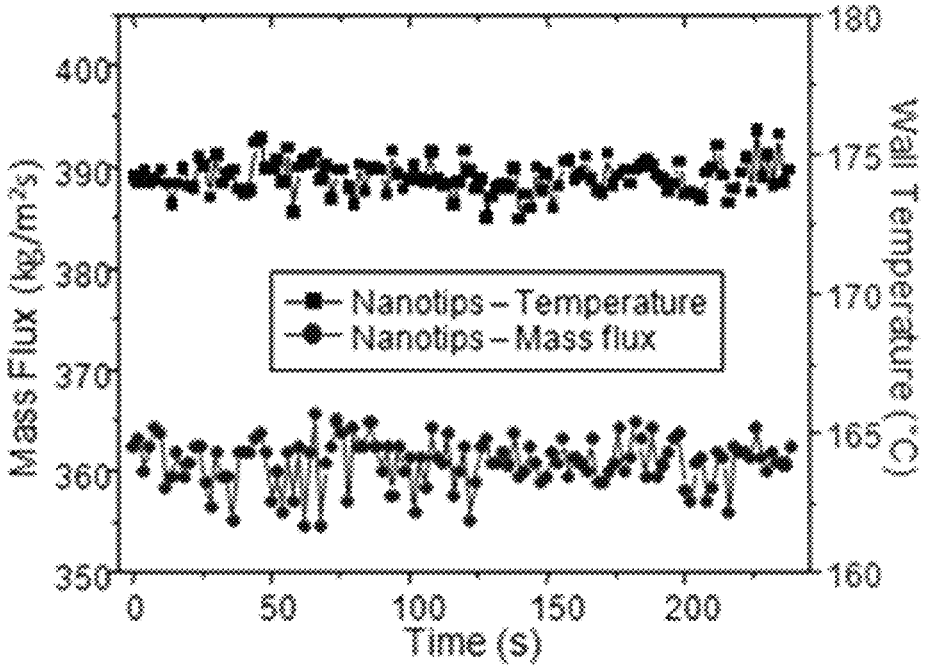
FIG. 7 shows the transient wall temperature and mass flux at a heat flux of 502 W/cm$^2$.

Suppressed Flow Boiling Instabilities:

The transient data of the exit pressure, mass flux and wall temperature during flow boiling in microchannels were used to measure the flow boiling instabilities as shown in FIGS. 6*a*-6*d*. Microchannels with smooth walls were used as the baseline. FIG. 6*a* indicated a low-frequency oscillations existed in microchannels with plain walls, which matches previous study on plain-wall microchannel without enhanced structures. The oscillation frequency is approximately 0.04 Hz. In FIG. 6*b*, as a result of nanotips induced BLs, oscillations under the similar sampling rate (0.5 Hz) were not obvious. It implies that the oscillation frequency in microchannels with nanotips induced BL is much lower than that in the microchannels with plain walls. FIGS. 6*c* and 6*d* show that the flow boiling instabilities were significantly suppressed by nanotips induced BLs in terms of transient mass flux and average wall temperature. It should be noted that the working heat flux in FIG. 6 was low due to the low working heat flux in microchannels with smooth walls. Flow boiling in microchannels with nanotips induced BLs at a heat flux of 502 W/cm$^2$ were shown to be stable in terms of transient mass flux and wall temperature (FIG. 7).

Figure 8A:
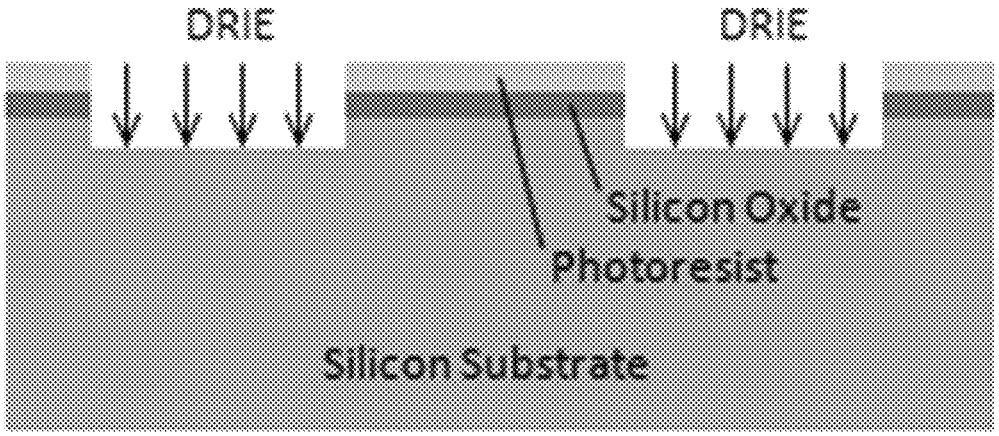
FIGS. 8*a*-8*c* show, sequentially, a schematic of the major fabrication steps of patternable nanotips according to the Examples, with FIG. 8*a* showing about 50 μm deep trenches formed by by DRIE, FIG. 8*b* showing re-patterned silicon oxide mask to make the mask about a μm wider (gap thickness) than the original trench, and FIG. 8*c* showing the major channels and nanotip arrays formed by DRIE.
Figure 8B:
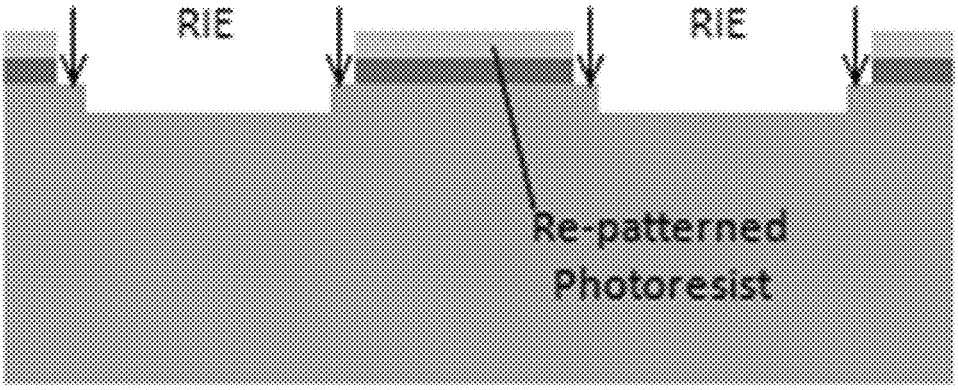
Figure 8C:
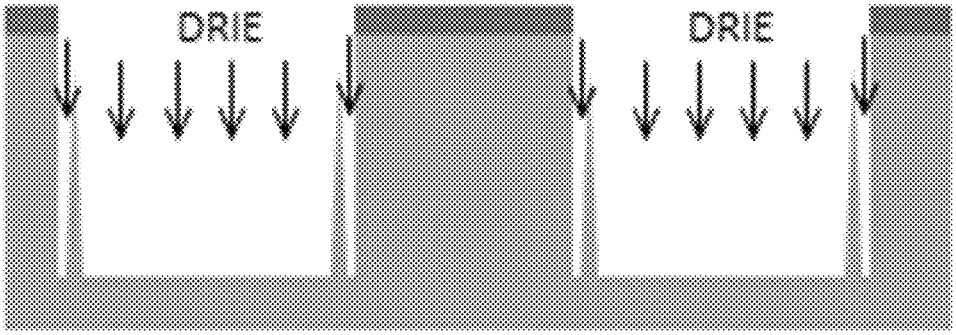

Fabrication of Nanotips:

In order to integrate and pattern nanotips in microchannels as shown in FIG. 4*a*, a new fabrication procedure was developed based. In the new fabrication process, a pre-etched pattern was used to determine the profile and distribution of nanotip arrays, which are located on the edge of pre-etched trenches (FIG. 8*a*). Wrinkled curtain-shape sculptures are formed at the lower part of side walls. Then, a secondary pattern removes oxide masks on the gaps between nanotip arrays and walls (FIG. 8*b*). The gap is then etched by DRIE. As a result, the tops of the curtain-shape sculptures will remain and nanotip arrays can be formed (FIG. 8*c*). The profile as well as major dimensions (width, height and pitch: δ, $h_t$ and $p_t$ as specified in FIG. 4*d*) of nanotip arrays can be designed and conveniently fabricated. This patternable-nanotip fabrication method does not use nanoscale lithography or nanoparticle as required in other nanofabrication techniques.

Example 2

Figure 1B:
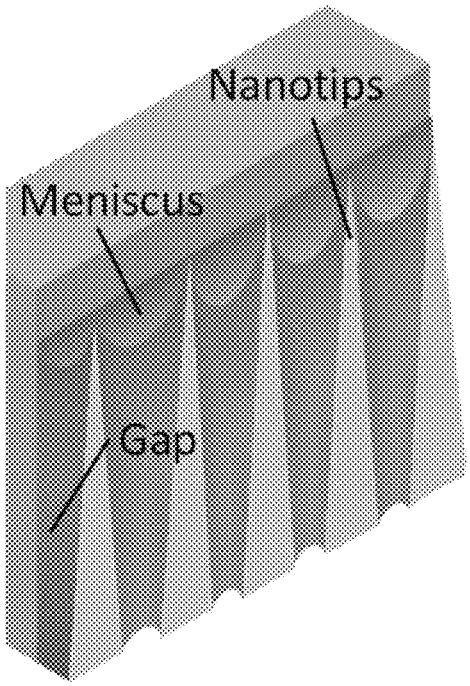
FIG. 1*b* shows a zoom-in view of the boundary layer structure of FIG. 1*a*. In this exemplary embodiment, the nanotip pitch is designed at least ten times smaller than the hydraulic diameter of the microchannel to facilitate the transformation of capillary pressure direction. The microgap formed between the sidewall and its neighboring nanotip array is carefully designed to reconstruct the boundary layer along the entire channel length.

Engineering nanostructures to reconstruct the boundary layer. As schematically illustrated in FIGS. 1*a* and 1*b*, silicon (Si) nanotip arrays (FIG. 1*a*) were designed along the sidewalls of Si microchannels. Scanning electron microscope (SEM) images in FIG. 4*a*-4*c* display the detailed features of Si nanotips in the microchannels. The height of nanotips was about 150 μm. The average pitch of nanotips was between about 2 μm and about 10 μm (FIG. 4*d*), at least 20 times smaller than the hydraulic diameter (220 μm) of microchannels. Thus, the capillary pressure generated by the nanotips is at least an order of magnitude larger than that generated from the microchannel cross-sectional plane, ensuring an effective transformation of capillary pressure from the cross-sectional planes to in-wall planes in the nanoengineered microchannels. To allow the boundary layer sustainable over the entire channel, a microgap with a width of about 5 μm was created between a sidewall and its neighboring nanotip array. As a consequence, liquid slugs in the Taylor flow persisting in plain-wall microchannels will be drawn into the microgap by the high capillary pressure generated by the nanotips. In addition, the reentrant-cavities formed by the nanotips are capable of enhancing nucleate boiling. The nanotip arrays were fabricated using the deep reactive-ion etching (DRIE) as shown in FIGS. 8*a*-8*c*. By patterning a monolithic Si nanotip array in Si microchannels, this novel nanoscale pattern approach can also enable a relatively precise control of boundary layer thickness. This simple yet unique technique, avoiding the need of nanoparticle masks, electron beam lithography or nano-catalysts, is low-cost fabrications and could be adopted by microelectromechanical (MEMS) industry.

The Two-Phase Transport Behaviors in Plain-Wall Microchannels:

To better understand two-phase transport in the novel nanoengineered microchannels, two-phase transport behaviors in the inlet manifold (FIG. 2*c*) and inside channels (FIG. 2*d*) were first investigated in plain-wall microchannels during flow boiling. Since the bubble dynamics in the inlet manifold determines the global liquid supply of the whole system, it is essential to understand the bubble expansion to collapse dynamics in the inlet manifold as schematically illustrated in FIG. 2*c*. It was found that bubbles first nucleate, grow in individual channels, and then coalesce into a large bubble in the inlet manifold. It was observed that the coalesced bubble undergo a continuous process of expansion (0-2.9 ms), shrinkage (4-14.1 ms) and eventual collapse (23.4 ms). It is noted that apparent bubble oscillation and reversing flow was observed between 4 and 14.1 ms, resulting from the nonequilibrium evaporation (expansion) and condensation (shrinkage) heat transfer processes. Since the time constant of the testing microdevice (6.4 ms) is nearly four times shorter than the bubble growth-collapse cycle (23.4 ms) in the inlet manifold, the wall temperature is susceptible to a hike and fluctuation in the cycle. Moreover, after the bubble collapse, liquid in the inlet manifold fails to spread to the whole channels because of the large flow resistance resulting from the high capillary pressure produced in the cross-sectional plane in the plain-wall microchannels (FIG. 2*c*). A large area of dry-wall in the downstream is formed, resulting in unwanted liquid flow crisis (4 ms to 12.2 ms) and pre-mature CHF conditions (FIG. 2*d*). Essentially, the flow crisis in the plain-wall microchannels involves two primary stages. First, the liquid evaporation in the plain-wall microchannels is confined in the microlayer, i.e., a small fraction of wall areas, therefore suppressing the rapid bubble expansion. Second, the coalesced bubbles in the manifold characterized by a long duration further block the liquid supply to dry out areas as a result of slow condensation in the process. In addition, two-phase flow in the plain-wall microchannels is characterized by the stochastic and transitional flow patterns. Note that the relatively static annular flow with a wavy liquid layer is formed in the plain-wall microchannels, but only at a high vapor or gas superficial velocity.

Figure 9:
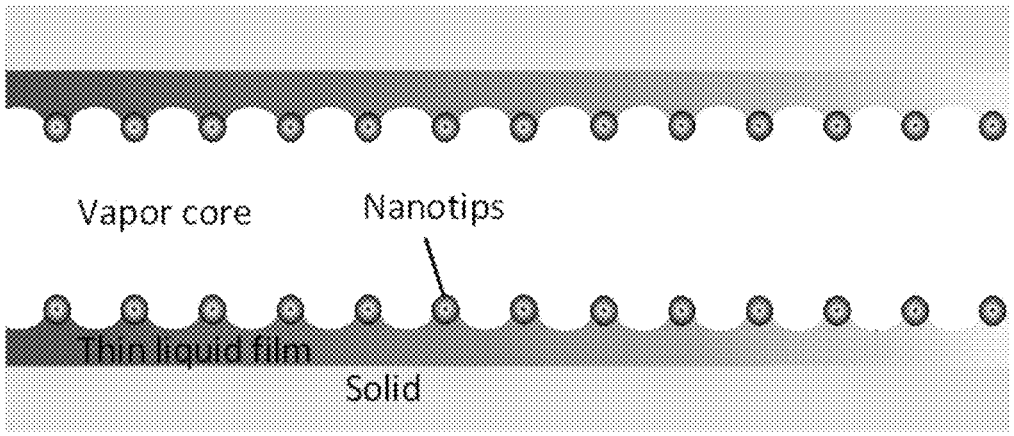
FIG. 9 shows a schematic drawing representing the highly ordered and favorable boundary structure created by nanotips inside channels.

The Effect of Nanotips on Regulating Two-Phase Flow Structures:

The two-phase transport phenomena in the nanoengineered microchannels exhibit distinctively different behaviors from those observed in the plain-wall microchannels. Unlike stochastic flow structures observed in the boundary layer of plain-wall microchannels, the flow structure of the boundary layer in the nanoengineered microchannels becomes highly ordered as schematically shown in FIG. 9 and experimentally captured by a high-speed camera for verification. Specifically, owing to the desired capillary effect in the wall-planes induced by the superhydrophilic nanotip arrays, a flat liquid boundary layer (a thin liquid film) was formed and sustained along the whole sidewalls of channels (FIG. 9). During the entire boiling process, the liquid flow and vapor core remained separated, suggesting the successful establishment of a favorable boundary layer structure. Moreover, it was found that the flat boundary layer prevails during the entire boiling process, i.e., from the onset of nucleate boiling (low vapor superficial velocity) to pre-CHF conditions (high vapor superficial velocity), indicating the efficacy of the boundary layer restoration using nanotips.

FIGS. 2*a* and 2*b* show the schematic drawings and experimental evolution of bubble dynamics in the inlet manifold of nanoengineered microchannels, which was experimentally performed at the working condition of mass flux 303 $kg/m^2 \cdot s$ and heat flux 285 $W/cm_2$. Unlike the liquid flow in the plain-wall microchannels, the establishment of a sustainable liquid boundary layer on the sidewall (FIG. 9 and the top panel of FIG. 2*a*) eliminates the occurrence of local dry out. Also, the highly efficient thin-film evaporation is extended to the entire channels, allowing for vigorous vapor generation and hence rapid bubble growth (FIG. 2*a*). Moreover, the rapid bubble growth further promotes direct contact condensation, accelerating the bubble collapse. Indeed, as shown in FIG. 2*a*, the bubbles in the inlet manifold of nanoengineered microchannel undergo similar growth-collapse oscillation dynamics as observed in the plain-wall microchannels, yet the bubble growth-to-collapse process is one order of magnitude faster than that in the plain-wall microchannels.

The reconstruction of the boundary layer also radically alters the flow structure inside the nanoengineered microchannels. FIGS. 2*a* and 2*b* show details the two-phase flow structure inside the nanoengineered microchannels. Compared to the plain-wall microchannels, liquid slugs were not observed in the nanoengineered microchannels. During the time interval of 0 ms (bubbles from individual channels expanded into the inlet manifold) and 3.8 ms (the bubble starts to collapse), it was observed the formation of a vapor core due to the occurrence of dry out for a duration of 2.2 ms. However, the effect of this short duration dry out (2.2 ms) on the wall temperature is negligible, since it is three times shorter than the time constant of the testing microdevice (6.4 ms, refer to the Supplemental Materials). The formation of the vapor core in the nanoengineered microchannels induces highly desirable capillary flows on inner walls (from 6.5 ms to 7.4 ms in FIG. 4*d*), thereby engendering a rapid reconstruction of the liquid boundary layer along sidewalls. As verified by time-resolved snapshots, a rapid liquid renewal was generated in channels (6.5 ms), which can reach the end of the channel as experimentally validated. Interestingly, since the capillary pressure is initiated from the dry out in the nanoengineered microchannels, the reconstruction of the boundary layer can be activated in an on-demand manner, therefore timely and rapid liquid supply becomes possible. In short, the two-phase flow crisis persisting in plain-wall microchannels can be effectively prevented in the nanoengineered microchannels.

Figure 10A:
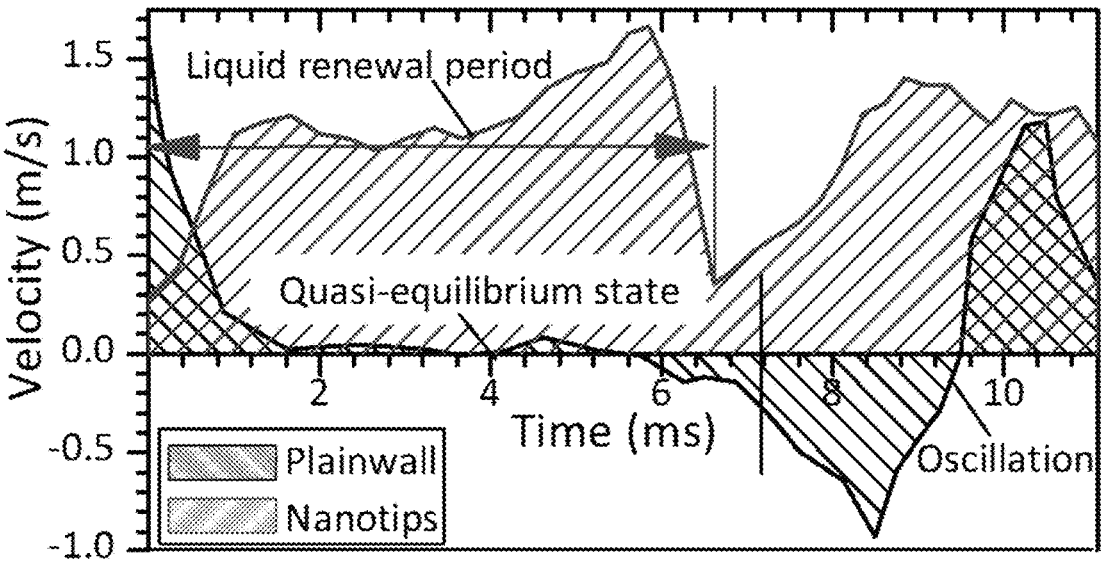
FIGS. 10*a*-10*c* generally show the characterization of water-front velocity and travelling distance of liquid renewal during a typical bubble growth and collapse period in the plain-wall and nanoengineered microchannels.
Figure 10B:
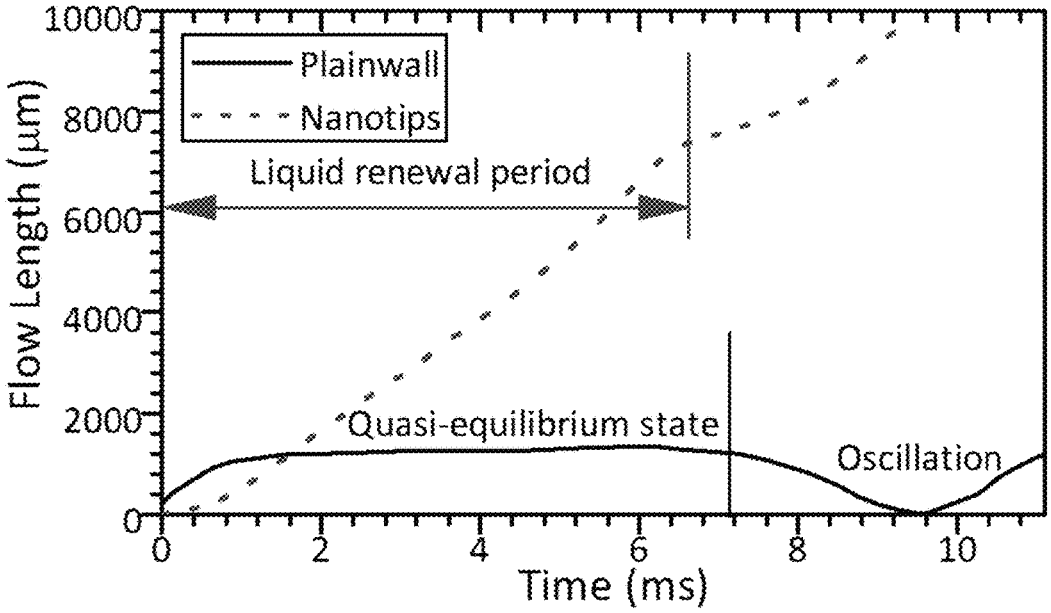
Figure 10C:
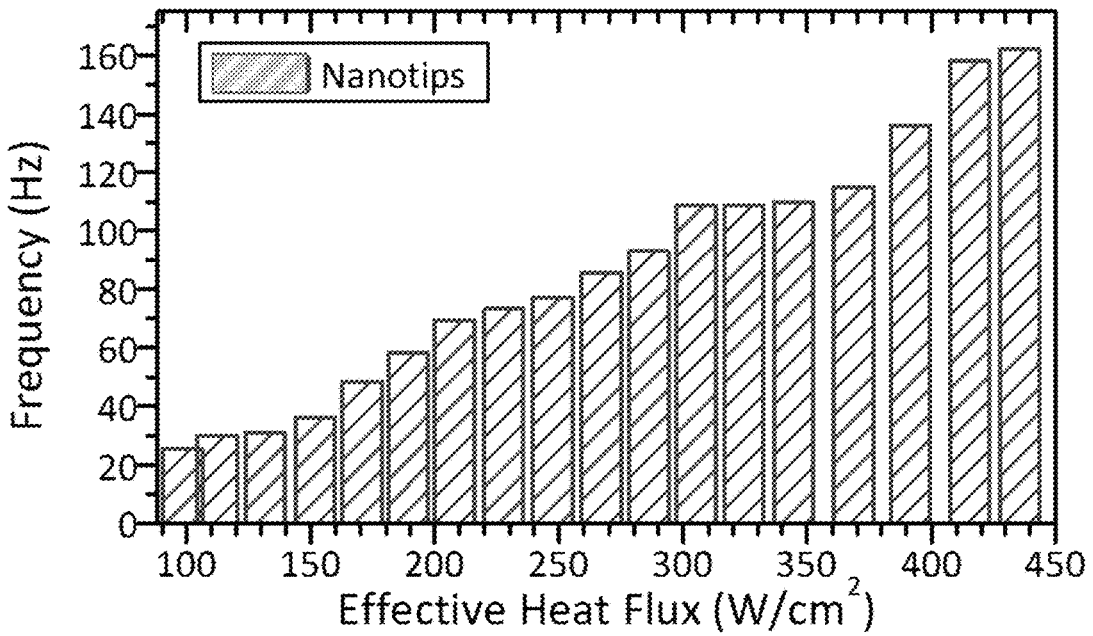

To further quantitatively characterize the different transport behaviors between the plain-wall and nano-engineered microchannels, in FIGS. 10*a* and 10*b* the variation of water-front velocity and travelling distance of liquid renewal during a typical bubble growth and collapse period, respectively, are plotted. The average liquid renewal velocity in the nanoengineered microchannels ranges between 1 m/s and 1.6 m/s (red line in FIG. 10*a*). By contrast, the velocity of liquid renewal in the plain-wall microchannels cannot be sustained. As shown in FIG. 10*a*, it drops nearly to zero in approximately 2 ms in the rest of 4 ms till reversing flows occurred in the period (FIG. 10*a*). Moreover, liquid renewal in the nanoengineered microchannels reaches the entire channel as indicated by the flow travelling distance (FIG. 10*b*), which is approximately four times longer than that in plain-wall microchannels (FIG. 10*b*). The enlarged flow traveling distance in the nanoengineered microchannels is owing to the establishment of the boundary layer, which avoids the reversing flow as observed in the plain-wall microchannels. FIG. 10*c* depicts the bubble growth-to-collapse frequency at different input heat fluxes. In all these cases, the bubble expansion-to-collapse frequency in the nanoengineered-microchannel is much higher than that in the plain-wall microchannels. All these results confirm our findings that of the nanotip-reconstructed boundary layer can effectively govern the flow structure, manage bubble confinement, and relieve flow crisis.

Discussion:

The establishment of a favorable boundary layer structure naturally allows for significantly enhancing two-phase transport performances. As shown in FIGS. 6*c* and 6*d*, the mass flux and wall temperature fluctuations in the nanoengineered microchannel are both less than 0.5%, which are 98.4% and 73.7% smaller than those in the plain-wall microchannels under the same working conditions (FIGS. 6*c* and 6*d*). The stable mass flow results from the higher frequency liquid renewal as discussed above. Similarly, the improved stability of the wall temperature is because of the reduced duration of dry out as well as the extension and promotion of highly efficient heat transfer modes including the thin film evaporation, the nucleate boiling, and the advection in the nanoengineered microchannels.

Conventionally, due to the premature CHF conditions, CHF in plain-wall microchannels is usually less than 200 $W/cm^2$ and is challenging to achieve a significant high CHF in microchannels. Although there is no IRs involved, CHF in the nanoengineered microchannels is substantially enhanced to approximately 585.5 $W/cm^2$ at a mass flux of 400 $kg/m^2$ s, corresponding to a 348% enhancement (FIG. 5*a*). Such an enhancement of CHF can be ascribed to the superior liquid supply mechanism created by the reconstruction of the boundary layer. The reconstruction of boundary layer allows for the high frequency liquid renewals in the whole channel. Additionally, the rapid capillary flows effectively reduce the local dry out on heating walls.

Figure 11:
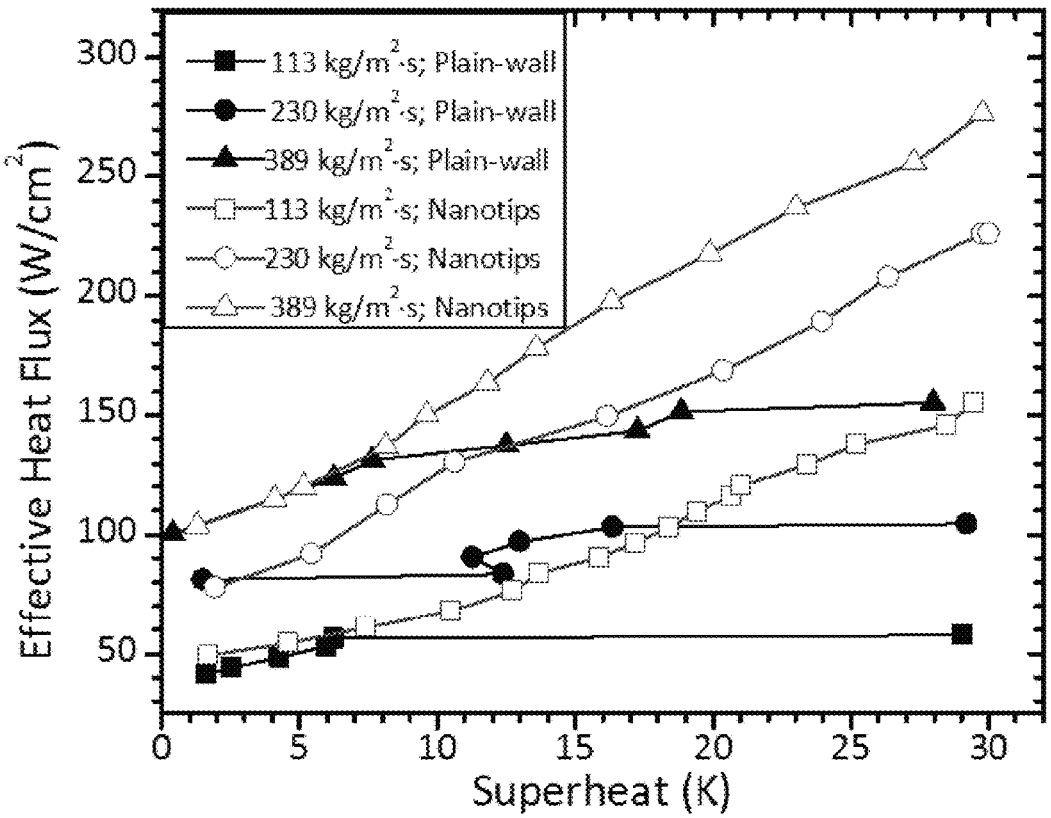
FIG. 11 shows a plot of the exceptional enhancements of flow boiling resulting from the reconstruction of boundary layer in the form of enhanced heat transfer rate as a function of wall superheat.

Compared to that in the plain-wall microchannels, approximately 169% enhancement of heat transfer rate was demonstrated in the nanoengineered microchannels (FIG. 11). Primary enhancement mechanisms include the promotion of thin-film evaporation from ONB to CHF conditions in the entire microchannels, the generation of advection by the high frequency and thoroughly liquid renewal, and the enhanced nucleate boiling resulting from the cavitation and the reentrant-cavities formed by nanotips.

The pressure drops between the plain-wall and nanaengineered microchannel configurations at two typical mass fluxes were also compared. At a low mass flux of 113 $kg/m^2$ s and working heat flux, the pressure drop in the nanoengineered microchannels is 17.9% higher than that in plain-wall microchannels, due to the increased flow resistance introduced by the nanoscale structure. Note that under the same mass flux (113 $kg/m^2$ s), the pressure drops in these two configurations become comparable when heat flux is higher than 45 $W/cm^2$. However, at a higher mass flux of 230 $kg/m^2 \cdot s$, an opposite trend was observed: the pressure drop across the nanoengineered microchannels becomes lower than that in the plain-wall microchannel. The unexpected decrease in the pressure drop in the nanoengineered microochannels is ascribed to the vapor and liquid flow separations, indicating that exceptional enhancements in all aspects of flow boiling in the nanoengineered microchannels are achieved with no penalty on the pressure drops.

In conclusion, a novel strategy is reported that allows for the reconstruction of the boundary layer in a sustainable and on-demand manner in nanoengineered microchannels. Through the incorporation of superhydrophilic nanostructures into the microchannels, the conventionally stochastic and transitional flow structures in plain-wall microchannels during flow boiling were transformed into an ordered one, allowing for the rapid bubble expansion-to-collapse in the inlet manifold and superior liquid supply. Moreover, the capability to reconstruct the boundary layer facilitates and promotes the highly efficient heat transfer modes (such as thin film evaporation, advection, and nucleate boiling) during the entire boiling process in the entire channels. As a result, exceptional flow boiling in nanoengineered microchannels has been achieved without the penalty on the pressure drop. It is envisioned that this novel concept of reconstructing boundary layers through the manipulation of structural architecture can open up many promising applications including realizing integration of two-phase cooling into next-generation high-power electronic chips with three-dimensional architectures and effective water management in fuel cells at high power density.

Method:

Micro/nanofabrication. The fabrication process started with a photo-masked and developed <100> silicon wafer. Nanotip arrays near side walls were etched by DRIE in microchannels. In the first step, fluorocarbon was produced from $C_4F_4$ gas as a polymeric passivation layer of the entire surfaces of microchannels. $SF_6$ gas was used to realize isotropic etching. High-power induced coupled plasma (ICP) was implemented to sputter away fluorocarbon layer on the bottom horizontal surfaces and etch silicon vertically. During fabrication process, a pre-etched pattern is used to define the distribution of nanotip arrays, which located on the edge of the pre-etched trench. Wrinkled curtain-shape sculptures were formed at the lower part of side walls. (FIG. 1*a*) Then, secondary patterning removed the oxide mask on microgaps between nanotip arrays and walls. Microchannels and nanotip arrays were created in the second DRIE (FIG. 1*b*). Additionally, since the tops of the curtain-shape sculptures were not removed, and nanotips were then created inside microchannels. On the backside, DC sputtering created a thin-film micro heater and three micro thermistors, which made of aluminum and titanium, respectively. The substrate is then anodically bonded to a Pyrex glass wafer (500-μm-thickness). Experimental study was performed on subcooled flow boiling in Si microchannels consisting of five parallel channels (length, width, and depth: 10 mm, 200 μm, and 250 μm) with nanotip arrays. The subcooling is between 40 and 60 K. A plain-wall microchannel array with identical channel dimensions was tested as a baseline.

Experimental Procedures:

Prior to experiments, heat loss as a function of temperature difference between the micro heat exchanger and ambient is determined by varying input heat fluxes without fluid flows. Thus, the heat loss can be estimated with high accuracy by linear curve fitting. The heater (also a microthermistors) is calibrated in an isothermal oven to generate a temperature vs. electric resistance curve using linear curve fitting. After assembly of the microchannel device on the test package, the flow rate is kept constant at a set value. Uniform heat fluxes are implemented by a digital power supply through the thin film heater at a step of approximately 2 W until approaching the CHF condition. At each step, the data acquisition system automatically records 120 sets of steady state data including power, local pressures, and temperatures at a four-minute intervals.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A microfluidic device, comprising:

a substrate defining a microchannel formed between a pair of vertical side walls and a bottom surface;

a pair of aligned nanotip arrays positioned within the microchannel, each nanotip array extending from the bottom surface of the substrate adjacent a vertical side wall such that a boundary layer is formed along an upper end of the vertical side wall between the nanotip array and the vertical side wall upon addition of a liquid into the microchannel, wherein each nanotip array comprises a plurality of vertically-extending nanotips; and a midchannel gap extending between the pair of aligned nanotip arrays, the midchannel gap having a length and a width, wherein the midchannel gap is free of nanotips along the length and the width, wherein the width of the midchannel gap is from 170 μm to 495 μm, wherein the microchannel defines a microgap resent between one of the pair of aligned nanotip arrays and a nearest vertical side wall, wherein the microgap has a width ranging from about 2.5 μm to about 15 μm.

2. The microfluidic device as in claim 1, the microchannel defining a diameter measuring the shortest distance between the side walls, wherein each nanotip defines an average pitch that is at least 20 times smaller than the diameter of the microchannel.

3. The microfluidic device as in claim 1, wherein each nanotip defines an average pitch that is at least 10 times smaller than the diameter of the microchannel.

4. The microfluidic device as in claim 1, wherein a pitch between the nanotips is from about 2 μm to about 10 μm.

5. The microfluidic device as in claim 1, the microchannel defining a diameter measuring the shortest distance between the side walls, wherein the diameter of the microchannel is about 200 μm to about 500 μm.

6. The microfluidic device as in claim 5, wherein each nanotip defines an average pitch of about 1 μm to about 20 μm.

7. The microfluidic device as in claim 1, wherein the substrate comprises silicon.

8. The microfluidic device as in claim 7, wherein a glass wafer is positioned on the substrate to enclose the microchannels.

9. The microfluidic device as in claim 1, wherein the pair of nanotip arrays are integrally formed from the same material as the substrate.

10. The microfluidic device as in claim 2, wherein the microgap is greater than 5.0 μm.

11. The microfluidic device as in claim 1, wherein the nanotips are tapered vertically.

12. The microfluidic device as in claim 1, wherein each of the nanotips are independent.

13. The microfluidic device as in claim 1, further comprising a second microchannel in parallel and having a substantially similar internal structure as the microchannel.

* * * * *